US008894281B2

(12) United States Patent
Town et al.

(10) Patent No.: US 8,894,281 B2
(45) Date of Patent: Nov. 25, 2014

(54) LIFTING BAG

(75) Inventors: Troy Town, Clinton, LA (US); Michael Schilling, Clinton, LA (US); Lewis Strickland, Clinton, LA (US); Michael Sanchez, Clinton, LA (US)

(73) Assignee: PacTec, Inc., Clinton, LA (US)

( * ) Notice: Subject to any disclaimer, the term of this patent is extended or adjusted under 35 U.S.C. 154(b) by 1369 days.

(21) Appl. No.: 11/464,065

(22) Filed: Aug. 11, 2006

(65) Prior Publication Data

US 2007/0127852 A1 Jun. 7, 2007

Related U.S. Application Data

(63) Continuation-in-part of application No. PCT/US2006/006662, filed on Feb. 24, 2006.

(60) Provisional application No. 60/657,512, filed on Feb. 28, 2005.

(51) Int. Cl.

| | |
|---|---|
| ***B65D 33/06*** | (2006.01) |
| ***B65D 88/16*** | (2006.01) |
| ***B66C 1/10*** | (2006.01) |
| ***B66C 1/22*** | (2006.01) |

(52) U.S. Cl.

CPC ..... *B65D 88/1618* (2013.01); *B65D 88/1681* (2013.01); *B66C 1/10* (2013.01); *B65D 88/1625* (2013.01); *B66C 1/226* (2013.01); *B65D 88/1668* (2013.01)

USPC ..... 383/17; 383/13; 383/24; 383/16; 383/18; 294/74

(58) Field of Classification Search

USPC ..... 383/16, 17, 18, 2, 13, 21, 22, 24; 220/3.1, 9.4; 294/74

See application file for complete search history.

(56) References Cited

U.S. PATENT DOCUMENTS

| | | | | |
|---|---|---|---|---|
| 525,951 A | | 9/1894 | Flaniken | |
| 977,698 A | | 12/1910 | Barksdale | |
| 1,512,228 A | * | 10/1924 | Mannocci | 383/18 |
| 1,955,538 A | * | 4/1934 | Deubener | 383/18 |

(Continued)

FOREIGN PATENT DOCUMENTS

| | | |
|---|---|---|
| JP | 11334786 | 12/1999 |
| WO | WO2007081361 A2 | 7/2007 |
| WO | WO2007081361 A3 | 7/2007 |

OTHER PUBLICATIONS

US AS International Searching Authority, Written Opinion, dated Apr. 2, 2009, for PCT/US06/06662.

(Continued)

*Primary Examiner* — Adam Waggenspack
*Assistant Examiner* — Peter Helvey
(74) *Attorney, Agent, or Firm* — Jones Walker LLP

(57) ABSTRACT

A lifting bag having at least one side wall and a closed bottom forming an interior, the bag further having a closable top portion connected to the sidewall and adapted to close the interior of the bag. The opening is a single slit centered on the bag top and closable with a zipper. The lifting bag includes a sling coupled to the bag, generally through a edge strip positioned at ore near the top edge of the bag. The bag can be constructed from a single multilayered sheet. The bag is used in conjunction with a lifting strap system.

20 Claims, 23 Drawing Sheets

(56) References Cited

U.S. PATENT DOCUMENTS

| | | | | | |
|---|---|---|---|---|---|
| 1,986,743 | A | * | 1/1935 | Musick | 383/18 |
| 1,986,898 | A | * | 1/1935 | Smithwick | 383/18 |
| 2,210,351 | A | * | 8/1940 | Westendorf | 190/119 |
| 2,215,689 | A | | 9/1940 | Dickson | |
| 2,216,527 | A | | 10/1940 | Weiss et al. | |
| 2,524,584 | A | | 10/1950 | Zehr | |
| 2,555,031 | A | | 5/1951 | Fox | |
| 2,574,345 | A | | 11/1951 | Montgomery | |
| 2,683,262 | A | | 7/1954 | Foss | |
| 2,687,321 | A | * | 8/1954 | Toffolon | 294/74 |
| 2,696,235 | A | * | 12/1954 | Toffolon | 383/18 |
| 2,712,797 | A | | 7/1955 | Woehrle et al. | |
| 2,740,445 | A | * | 4/1956 | Fornell | 383/22 |
| 2,861,735 | A | | 11/1958 | Faltin | |
| 2,965,407 | A | * | 12/1960 | Meisen | 294/74 |
| 2,998,340 | A | | 8/1961 | Conway et al. | |
| 3,167,209 | A | | 1/1965 | Jones | |
| 3,219,240 | A | | 11/1965 | Campbell, Jr. | |
| 3,306,328 | A | | 2/1967 | Markus | |
| 3,315,857 | A | * | 4/1967 | Eclov | 294/152 |
| 3,422,867 | A | | 1/1969 | Wu | |
| 3,459,357 | A | | 8/1969 | Egger et al. | |
| 3,468,102 | A | | 9/1969 | Farrar et al. | |
| 3,481,461 | A | | 12/1969 | Paxton | |
| 3,539,360 | A | | 11/1970 | Wood | |
| 3,563,433 | A | * | 2/1971 | Yoshiura et al. | 294/157 |
| 3,567,110 | A | * | 3/1971 | Susuki et al. | 383/10 |
| 3,570,751 | A | | 3/1971 | Trewella | |
| 3,578,213 | A | | 5/1971 | Clarke | |
| 3,617,418 | A | | 11/1971 | Miller | |
| 3,674,073 | A | | 7/1972 | Hendon | |
| 3,756,469 | A | | 9/1973 | Clark et al. | |
| 3,834,528 | A | | 9/1974 | Pickford et al. | |
| 3,888,163 | A | | 6/1975 | Watanabe | |
| 3,893,595 | A | | 7/1975 | Khanna et al. | |
| 3,923,222 | A | * | 12/1975 | Groves | 294/157 |
| 3,987,959 | A | | 10/1976 | Deards et al. | |
| 4,113,146 | A | | 9/1978 | Williamson | |
| 4,143,796 | A | | 3/1979 | Williamson | |
| 4,157,103 | A | * | 6/1979 | La Fleur | 141/98 |
| 4,194,602 | A | * | 3/1980 | Allen | 224/578 |
| 4,194,652 | A | | 3/1980 | Williamson et al. | |
| 4,207,937 | A | | 6/1980 | Sandeman et al. | |
| 4,224,970 | A | | 9/1980 | Williamson | |
| 4,362,199 | A | * | 12/1982 | Futerman | 383/17 |
| 4,385,953 | A | | 5/1983 | Beck | |
| 4,395,067 | A | | 7/1983 | Robin | |
| 4,418,806 | A | | 12/1983 | Johnson | |
| 4,441,748 | A | * | 4/1984 | St. Germain | 294/74 |
| 4,448,451 | A | * | 5/1984 | Colson | 294/74 |
| 4,461,402 | A | | 7/1984 | Fell et al. | |
| 4,466,659 | A | * | 8/1984 | Carpentier et al. | 297/188.06 |
| 4,479,243 | A | * | 10/1984 | Derby et al. | 383/24 |
| 4,480,766 | A | * | 11/1984 | Platt | 222/105 |
| 4,493,109 | A | | 1/1985 | Nattrass | |
| 4,557,400 | A | | 12/1985 | Clarke | |
| 4,564,161 | A | | 1/1986 | Frye | |
| 4,570,820 | A | | 2/1986 | Murphy | |
| 4,610,028 | A | * | 9/1986 | Nattrass | 383/7 |
| 4,640,328 | A | * | 2/1987 | Arney | 220/9.1 |
| 4,671,733 | A | | 6/1987 | Krein | |
| 4,688,979 | A | * | 8/1987 | Kupersmit | 414/403 |
| 4,723,327 | A | * | 2/1988 | Smith | 5/89.1 |
| 4,730,942 | A | | 3/1988 | Fulcher | |
| 4,754,914 | A | | 7/1988 | Wischusen, III | |
| 4,759,742 | A | | 7/1988 | Achelpohl | |
| 4,792,171 | A | | 12/1988 | Lamy | |
| 4,792,239 | A | * | 12/1988 | Hamada et al. | 383/22 |
| 4,817,824 | A | | 4/1989 | LaFleur | |
| 4,834,439 | A | * | 5/1989 | van de Kamp | 294/74 |
| 4,850,508 | A | | 7/1989 | Lee | |
| 4,871,046 | A | | 10/1989 | Turner | |
| 4,969,750 | A | | 11/1990 | Russo | |
| 5,041,317 | A | | 8/1991 | Greyvenstein | |
| 5,066,597 | A | | 11/1991 | Stinson | |
| 5,073,035 | A | | 12/1991 | Williams | |
| 5,108,196 | A | | 4/1992 | Hughes | |
| 5,110,005 | A | | 5/1992 | Schilling | |
| 5,127,893 | A | | 7/1992 | Lafleur | |
| 5,188,460 | A | * | 2/1993 | Dorse | 383/18 |
| 5,269,579 | A | | 12/1993 | DeCrane | |
| 5,340,218 | A | * | 8/1994 | Cuthbertson | 383/67 |
| 5,518,315 | A | * | 5/1996 | Nichols | 383/119 |
| 5,564,833 | A | * | 10/1996 | Proffitt | 383/22 |
| 5,607,237 | A | * | 3/1997 | LaFleur | 383/22 |
| 5,641,189 | A | * | 6/1997 | Landman | 294/77 |
| 5,664,887 | A | | 9/1997 | LaFleur | |
| 5,695,286 | A | * | 12/1997 | Williamson et al. | 383/24 |
| 5,738,443 | A | * | 4/1998 | Renaud | 383/67 |
| 5,810,478 | A | | 9/1998 | LaFleur | |
| 5,860,525 | A | | 1/1999 | Bellehchili | |
| 5,887,923 | A | * | 3/1999 | Gardner, III | 294/81.55 |
| 5,938,338 | A | | 8/1999 | McDonough | |
| 5,967,579 | A | | 10/1999 | Hebert | |
| 6,079,934 | A | | 6/2000 | Beale | |
| 6,109,678 | A | * | 8/2000 | Esfandiari et al. | 294/152 |
| 6,142,727 | A | | 11/2000 | Beale | |
| 6,155,772 | A | | 12/2000 | Beale | |
| 6,186,713 | B1 | | 2/2001 | Bonerb | |
| 6,250,488 | B1 | | 6/2001 | Narahara et al. | |
| 6,305,845 | B1 | | 10/2001 | Navin | |
| 6,374,461 | B1 | * | 4/2002 | Gober et al. | 16/444 |
| RE37,915 | E | | 12/2002 | Lapoint, III | |
| 6,516,965 | B1 | * | 2/2003 | Perkins | 220/9.4 |
| 6,986,456 | B2 | * | 1/2006 | Jone | 229/117.11 |
| 7,073,676 | B1 | | 7/2006 | Town | |
| 7,437,784 | B1 | * | 10/2008 | Turnipseed | 5/510 |
| 7,461,761 | B2 | * | 12/2008 | Hildreth | 222/181.2 |
| 7,845,511 | B1 | * | 12/2010 | Strickland et al. | 220/495.11 |
| 2001/0000464 | A1 | * | 4/2001 | Beale | 414/607 |
| 2003/0216607 | A1 | * | 11/2003 | Lindgren et al. | 588/258 |
| 2007/0009185 | A1 | * | 1/2007 | Lee | 383/16 |
| 2008/0031550 | A1 | | 2/2008 | Town | |

OTHER PUBLICATIONS

US AS International Searching Authority, Search Report and Written Opinion, dated Feb. 13, 2007, for PCT/US06/31369.

International Bureau of WIPO, Int'l Preliminary Report on Patentability, dated Mar. 24, 2009, for PCT/US2006/006662.

* cited by examiner

LIFTING BAG

PRIORITY CLAIM

This application is a continuation in part of International Application PCT/US06/06662 (which designated the United States) filed Feb. 24, 2006 which claimed priority to U.S. provisional application No. 60/657,512 filed Feb. 28, 2005, all of which this application claims priority to and which are hereby incorporated by reference in their entirety.

APPENDIX A

Attached hereto as an appendix is the disclosure of PCT/US06/06662, hereby incorporated by reference

FIELD OF THE INVENTION

This invention relates to large lifting bags for lifting and transporting hazardous or radioactive materials.

BACKGROUND OF THE INVENTION

Transportation of bulk materials in the United States is regulated by the United States Department of Transportation, particularly for transportation of hazardous or radioactive materials. See 49 CFR pt. 173 (incorporated by reference). In particular, containers for transportation of hazardous and radioactive materials are required to meet certain design safety criteria. See generally, 49 CFR 173 subpart I. Certain packaging design guidelines for Industrial Packaging, Types 1, 2, or 3, or Type A package (see 40 CFR 173.403) are specified in 49 CFR 410-411. Transportation of bulk materials is similarly regulated in Europe and elsewhere. Bags designed to large scale storage and transportation are typically adapted to carry loads in excess of 10000 pounds.

The United States guidelines specify testing requirements that packaging must undergo to be certified as meeting the guidelines. See 49 CFR 173.465. Included in the testing procedures are a free drop test, and a stacking test. The free drop test requires a package to be loaded or filled to its design weight capacity and dropped from a specific height (1-4 feet, depending on design weight) and to maintain structural integrity after impact. The stack test requires a loaded package to be subject to a compressive load of five times the actual capacity weight of the package. Such testing requirements place substantial restrictions on possible construction of the packaging. For packaging that comprises a flexible bag capable of being lifted when loaded, the drop test and stack test present heavy design hurdles. One possible flexible bag design is shown in U.S. Pat. No. 6,142,727 (the '727 patent), attached hereto and made a part hereof, in its entirety.

The lifting bag in the '727 patent has several drawbacks. First, the lifting straps are attached to the outer cover of the bag, which places stress on the outer cover during lifting operations. Second, the lifting straps encircle the bottom of the bag in an even rectangular grid, which results in an even distribution of weight during lifting provided the lifting forces are evenly distributed. If the lifting forces are not evenly distributed, the bag is subject to torsional forces and the rectangular webbing support grid on the bottom of the bag will not sufficiently compensate for these twisting forces, resulting in bag deformation and unnecessary stress, particularly on the bag seams. Further, an uneven load distribution within the bag can result in torsional forces despite the application of evenly applied lifting forces. Finally, the bag employs a complex flap folding procedure to seal the bag, which is cumbersome and time consuming.

Another lifting bag design is that disclosed in PCT/US06/06662 (the '662 application, hereby incorporated by reference in its entirety). This design uses a bottom support and side support lifting apparatus, where the support members are generally webbing or ropes, and is attached to the bag at designated locations, either on the bottom or the sides, but not the bag top portion. The bag can be constructed from a series of panels. While the bag design is less complicated that that of the '727 patent, construction can be arduous and time consuming.

SUMMARY OF THE INVENTION

A lifting bag including a lifting strap system designed to carry substantial loads. The lifting strap system may be detached from the bag but coupled to the bag, particularly, detached near the bag top portion. The lifting system can be one piece or a two piece unit. The lifting bag has a edge strip attached to or near the top edge to allow for placement of the lifting strap system. One of the bags that can be used has a top center zipper, and can be constructed from a single sheet of fabric. To open the bag, the zipper is unzipped and the top portion of the bag is inverted and placed over the frame or container.

BRIEF DESCRIPTION OF THE DRAWINGS

FIG. 10 B is a top view of another embodiment of an edge strip

DETAILED DESCRIPTION OF THE INVENTION

Figure 1:
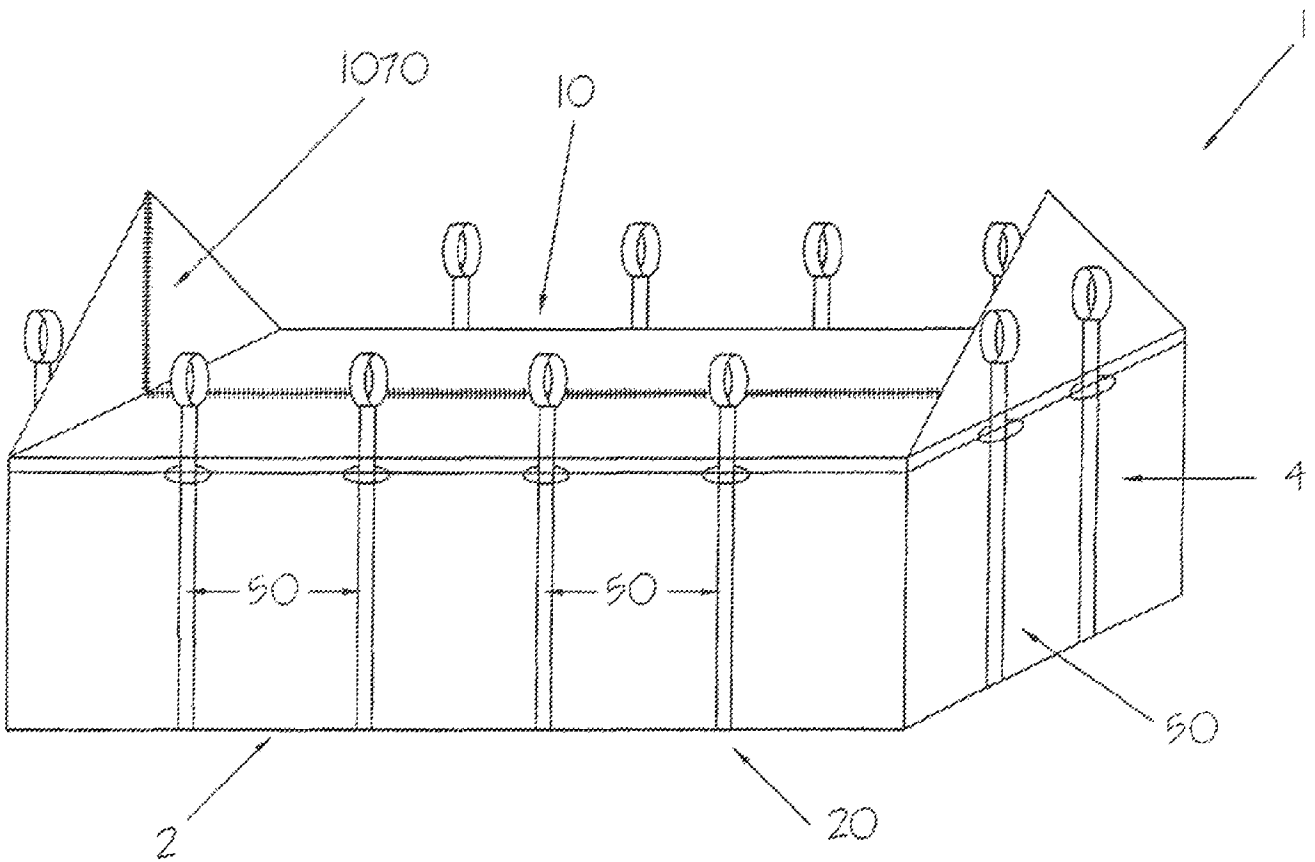
FIG. 1 is a perspective view of one embodiment of a lifting bag.
Figure 2A:
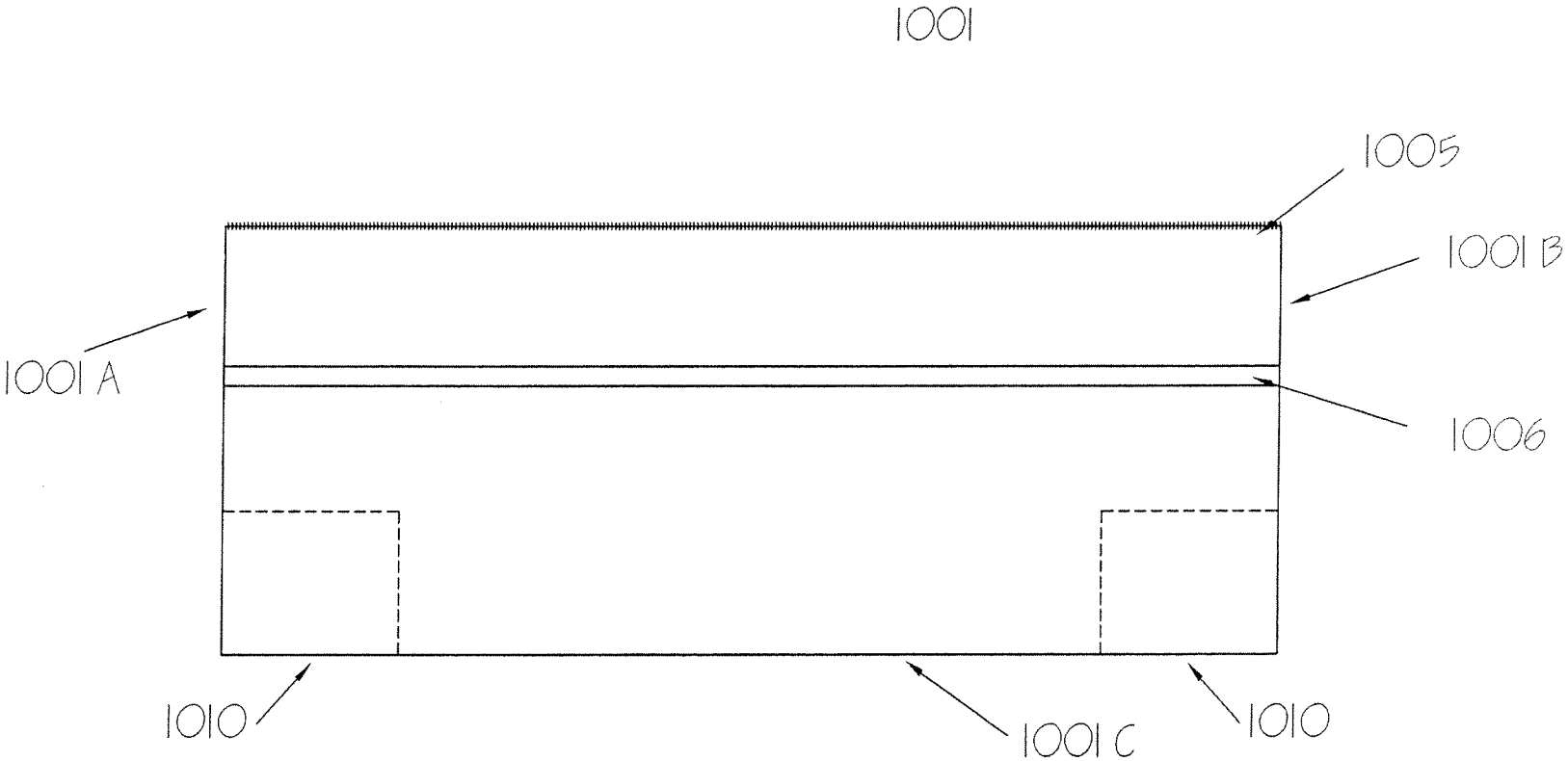
FIG. 2A is a plan view of the single sheet construction.
Figure 2B:
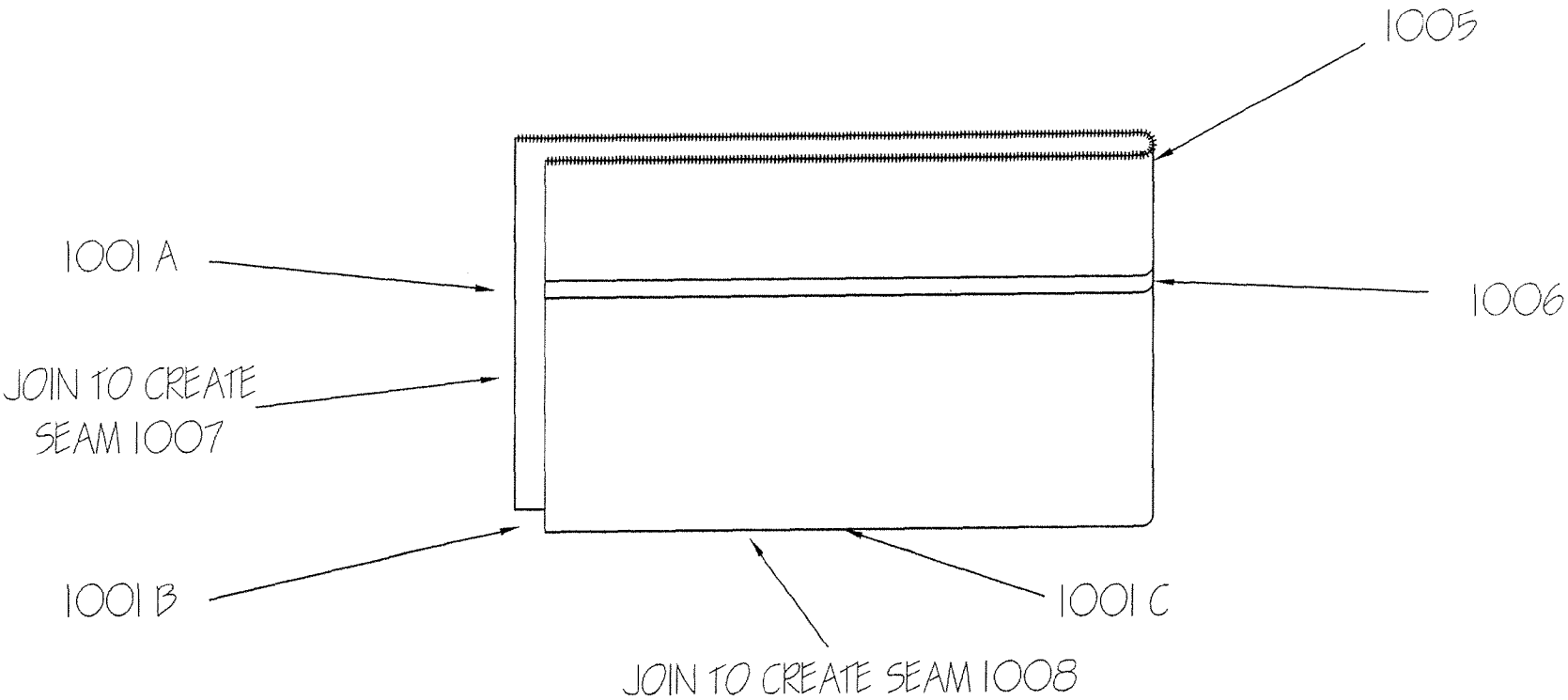
FIG. 2B is a plan view of the folded sheet of FIG. 2A.
Figure 2C:
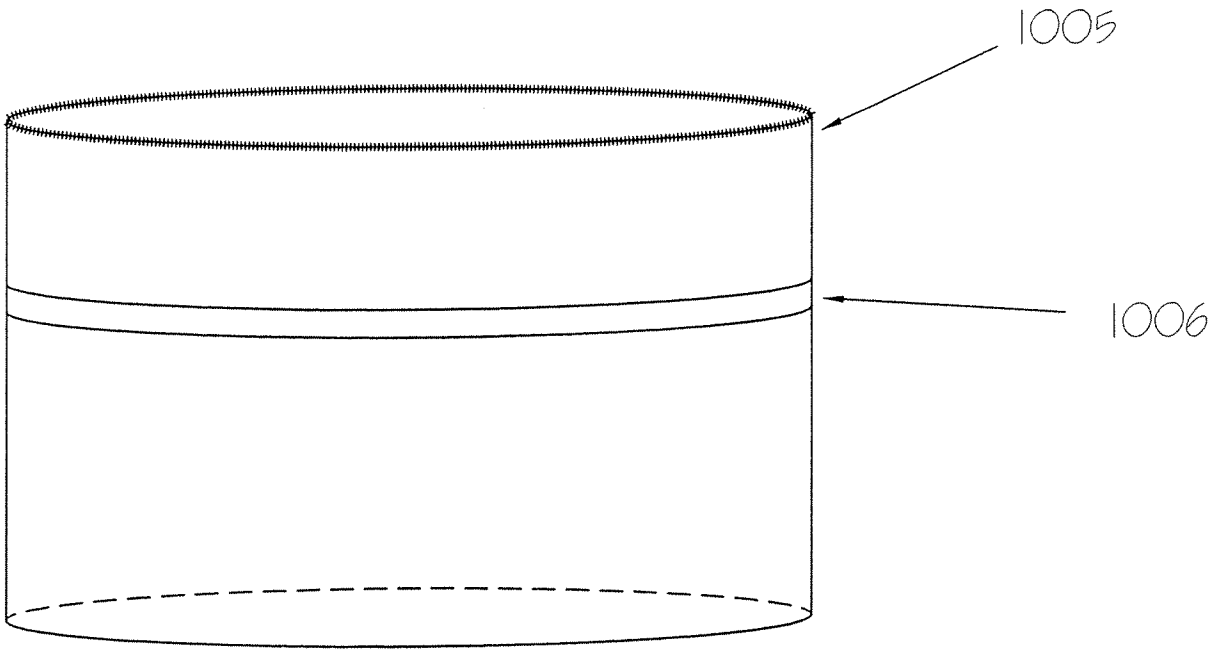
FIG. 2C is a perspective view of the cylinder formed by joining the sides of the sheet in FIG. 2B
Figure 2D:
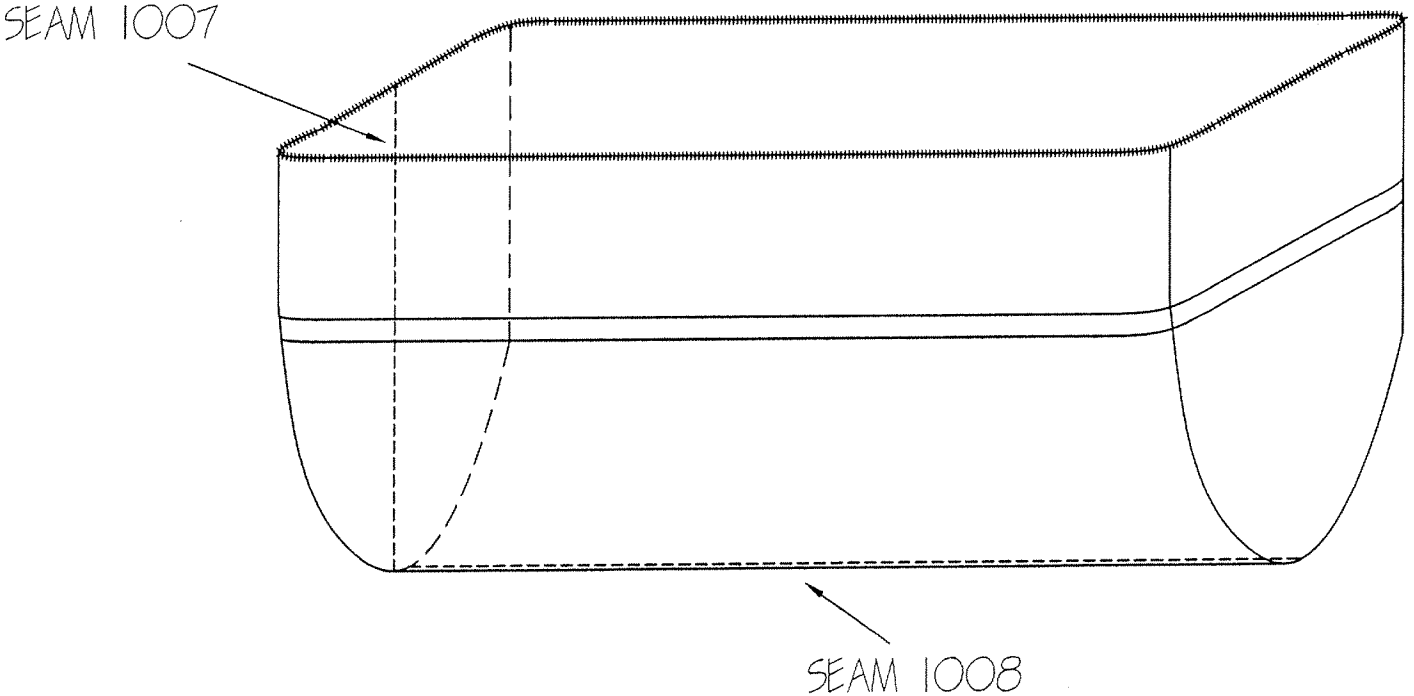
FIG. 2D is a perspective view of the cylinder in FIG. 2C which a bottom seam
Figure 5:
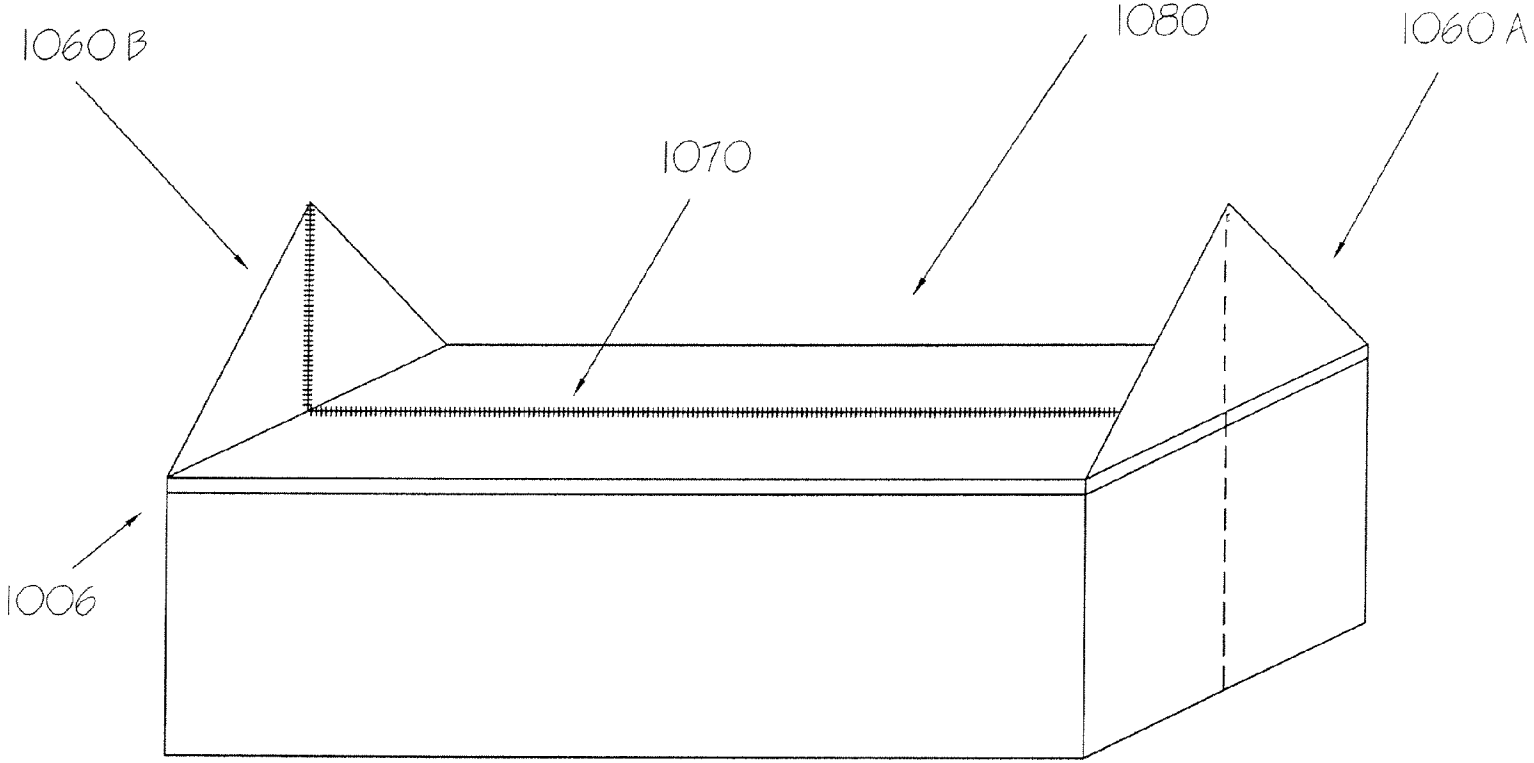
FIG. 5 a perspective view of the completed bag of FIG. 3 with the top zippered closed.
Figure 6A:
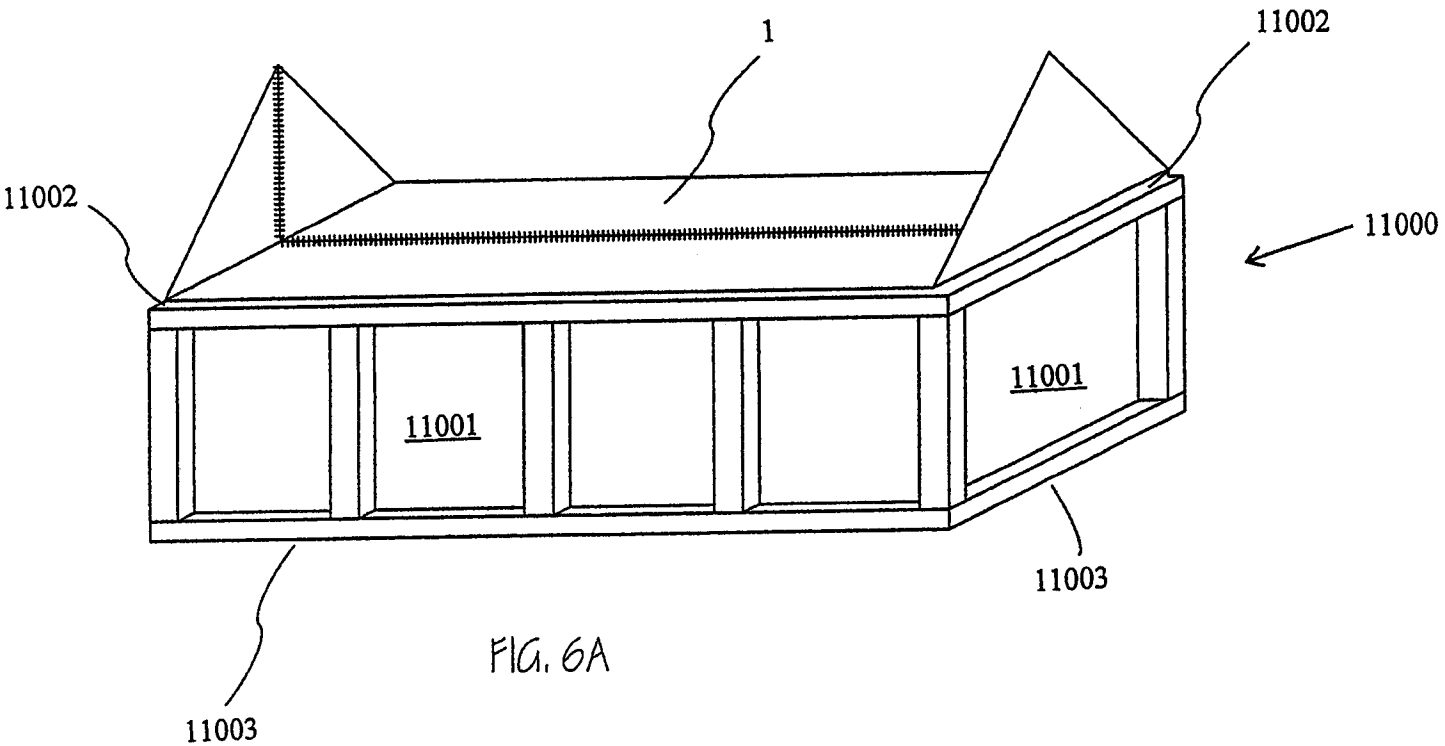
FIG. 6A is a perspective view of the competed bag of FIG. 5 placed in a container with the top zippered closed.
Figure 6B:
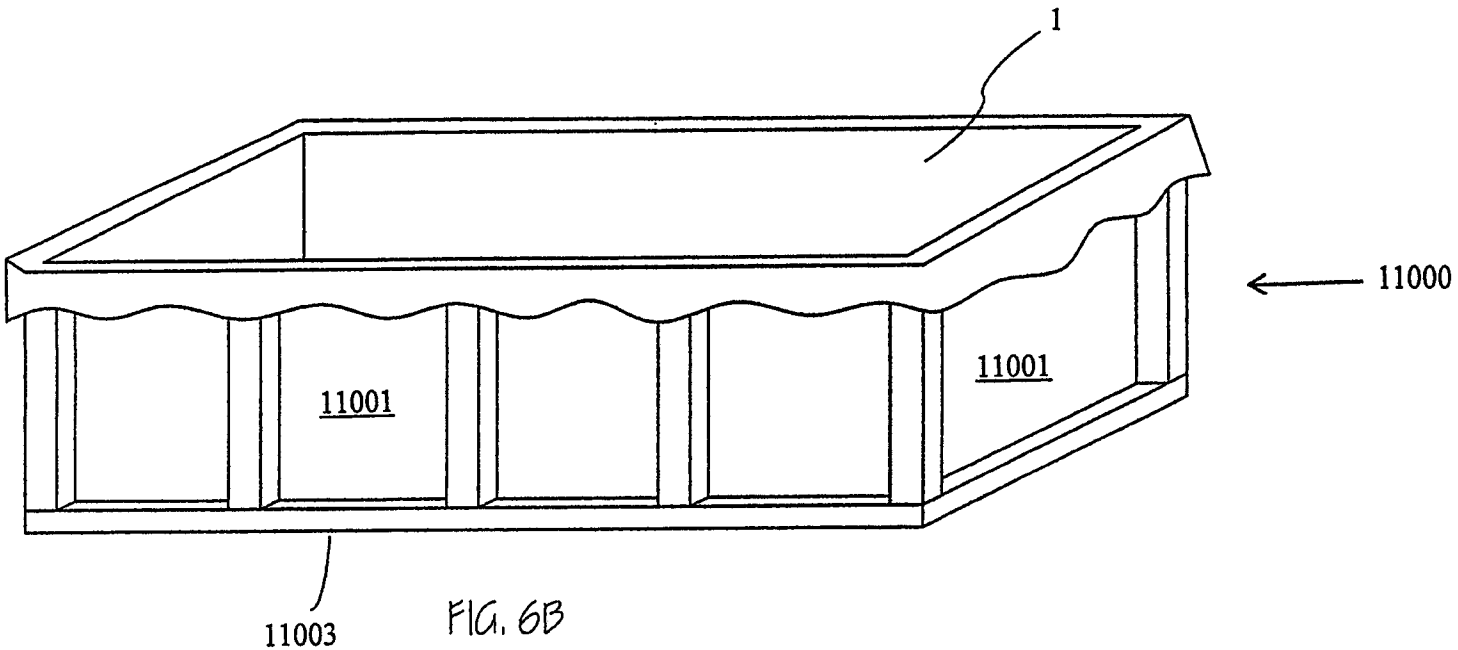
FIG. 6B is a perspective view of the completed bag of FIG. 5 in a container with the top open and inverted.
Figure 7:
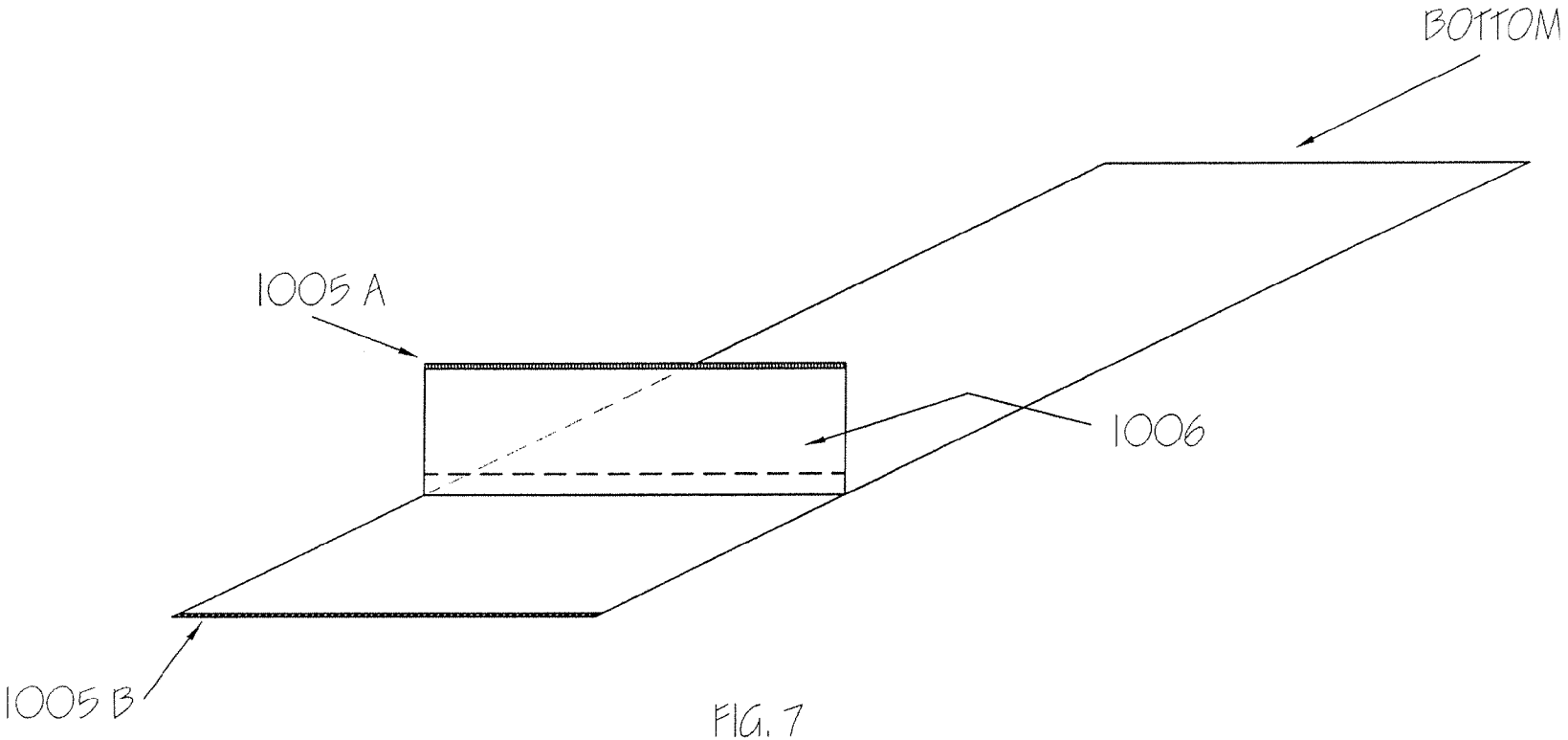
FIG. 7 is a perspective view of a two layer single piece construction having two closable tops.

Shown in FIG. 1 is one embodiment of the invention, comprising a lifting bag 1, constructed to meet IP-2 standards for 24,000 lbs capacity. The bag 1 has two opposing sidewalls 2, 3; two opposing end walls 4, 5; a top portion 10; and a bottom 20. As shown, the lifting bag 1 forms a rectangular shaped enclosure (as shown, about 8'×7'×4.5° or 8'×5.5'×5.5'), having an interior volume, with an open top defined by the upper ends of the end walls and sidewalls. Other bag shapes and sizes are possible, such as a cubical shape or cylindrical shape. As the bag is not self supporting, a frame 11000 must be provided to support the bag during loading, such as shown in FIGS. 6A and 6B. A metal or wooden frame can be used, such as shown in FIGS. 5-7 of U.S. Pat. No. 6,142,727, or a bulk container can be used, and all types of support will be considered as "frames." As shown in FIG. 6A, the frame 11000 has sidewalls 11001 with a upper terminating edge 11002 and a lower terminating edge 11003. The bag 1 is positioned in the interior of the frame 11000, and the top portion of the lifting straps 50 (later described) lie over the outside of the frame 11000. The tops of the lifting straps may be secured to the exterior of the frame if desired. Alternatively, the bag may have support loops attached to the exterior to tie to the frame support frame during filling operations to tie the bag to the support structure.

The bag sidewalls and bottom are constructed of a robust flexible fabric, such as 6.0-18+ oz coated woven (or non-woven) polypropylene or polyethylene, with coated polypropylene being preferred. The coating, if provided, is usually polyethylene (typically 1-3 mil coating). It is preferred that the top also be made of a robust flexible fabric. For strength, the bottom layer may be a multilayer construction. For one particular embodiment, a lifting bag, having two layers of 6.0 oz coated woven polypropylene, or one layer of 6.0 oz woven polypropylene and a second layer of 8 oz woven polypropylene have been utilized (more preferred). The bag may have a separate liner positioned in the interior of the bag (a bag in a bag) with the liner attached to the top of the bag, and if desired, also attached to the four side corners of the bag.

Various constructions of the enclosure are possible: the sidewalls and end walls may be constructed from a single piece of fabric; the bottom and sidewalls (or bottom and end walls) may each be constructed from a single sheet of fabric, etc. One embodiment uses separate cut pieces or panels of fabric for each wall, bottom and top, with the panels joined by stitching. Alternatively, two pieces of fabric could be overlaid in an "x" or "t" shape creating a double layer for the bottom of the bag. When separate pieces of fabric are used, the pieces can be joined through stitching. Means other than stitching can be utilized to join wall/bottom/top members, such as plastic welding (heat welding, radio frequency welding, etc), adhesion or a combination of means.

A preferred means of construction is to build the bag from a single fabric sheet 1005 or a single multilayer fabric sheet. The multiple sheets can be coextensive when laid on top of one another, or the innermost fabric can be shorter in height that the outermost fabric if it is not desired to have the top of the resulting bag lined. An additional horizontal layer positioned near the bottom edge can be used to form a reinforced bottom. Other multilayered designs are possible by modifying the laminated structure of a multilayer sheet. For ease of explanation, construction will be described using a single sized multilayer fabric piece, with two side edges 1001A and 1001B, a bottom edge 1001C, and a top edge 1001D, as shown in FIG. 2.

Using a single fabric piece constructed as described, the resulting assembled bag will have a center opening on the bag top, preferably closable with a zipper 1070, such as shown in FIG. 1. To construct the bag with a zippered opening, one side of a zipper chain 1005 is attached one of the long edges of the fabric, shown in FIG. 2A, at the top edge. Generally, a sewn attachment is preferred forming a seam. It is preferred that the edges of the fabric on the seam be folded over about 0.5-2 inches to create extra strength at the seam. This overlap is desired for all seams on the bag.

Also attached lengthwise and parallel to the half zipper chain is a edge strip 1006. In the present embodiment, this strip is positioned so that when the bag is complete, the edge strip 1006 is positioned at or near the top edge of the completed bag. As shown the strip is a single strip of fabric, here a strip of 2" wide polyester webbing. The edge strip may be several discontinuous strips place only where needed to couple to the lifting straps in the lifting strap system, as later described. Other positions of the edge strip on the bag sides may be desired, or additional edge strips may be included on the bag sides as needed (e.g. a strip positioned near the bag sidewall center or bag sidewall bottom edge). The edge strip 1006 is preferred but can be eliminated depending upon the type of lifting system used to lift a loaded bag, as later described. If the edge strip is not used, it is still desired, in a multilayered fabric embodiment, to place a stitch along a horizontal line at or near the location that will become the top edge of the completed bag. Such a stitch or join will keep the inner liner material from separating or sagging away from the outer material.

For instance, to form an 8'4"×8'10' bag, a single or multilayer fabric piece of 12×14'6' fabric is used. To construct the bag, the single piece of bag fabric 1001 has the two ends 1001A and 1001B joined together, creating an opened top and bottom oblong cylinder FIG. 2C. The bottom edge of the cylinder 1001C (the edge opposite that having the zipper edge) is closed by attaching (preferably a sewn attachment) the opposing sides of the bottom edge of the cylinder (e.g. flatten the cylinder, creating two opposed sides, and attach the opposed sides). See FIG. 2D. The resulting structure resembles an open end toothpaste tube, with a seam 1008 running across the tube's bottom 1, and up one side 1007. It is preferred that the tube like structure be created in a single step: the fabric piece 1001 is folded to align edges 1001A and 1001B, and a join (such as by sewing) edges 1001A and 100B together, and the opposing sides of the folded bottom edge 1001C joined together, creating a bottom seam 1008 and single side seam 1007 (see FIG. 2B).

Figure 3A:
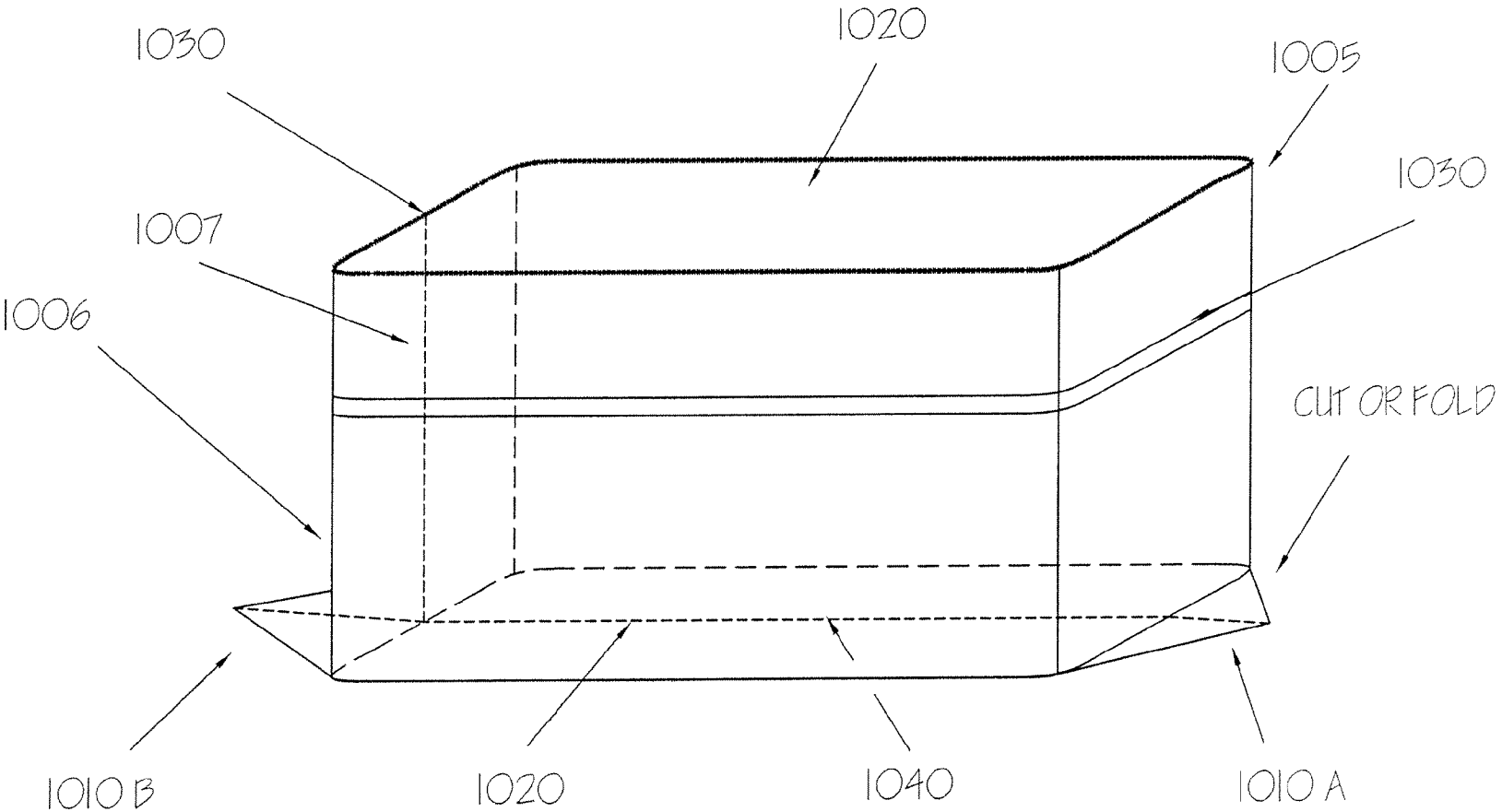
FIG. 3A is a perspective view of the bag of FIG. 2D with a flattened bottom.
Figure 3B:
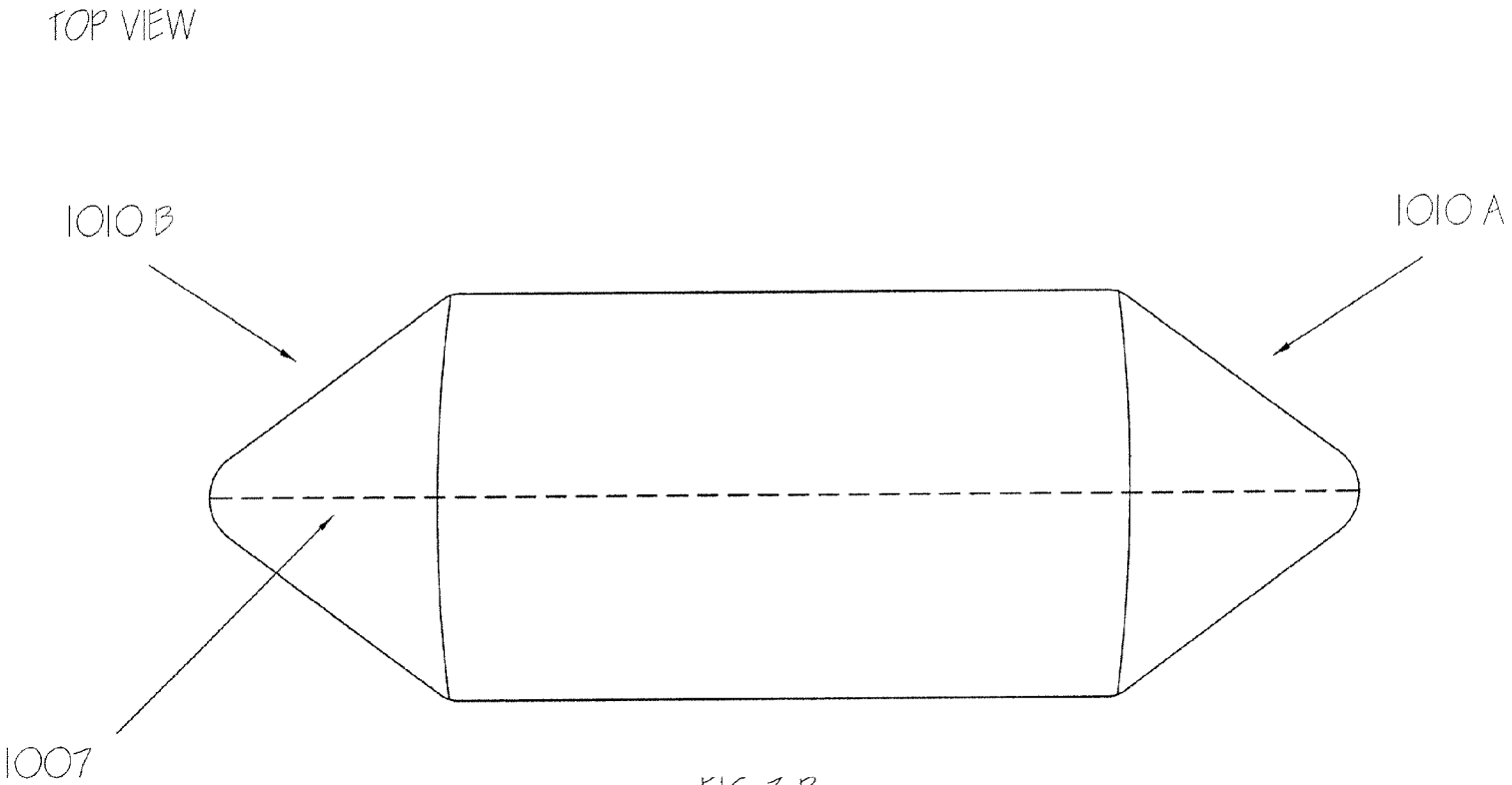
FIG. 3B is a top view of the bag of FIG. 3A.
Figure 3C:
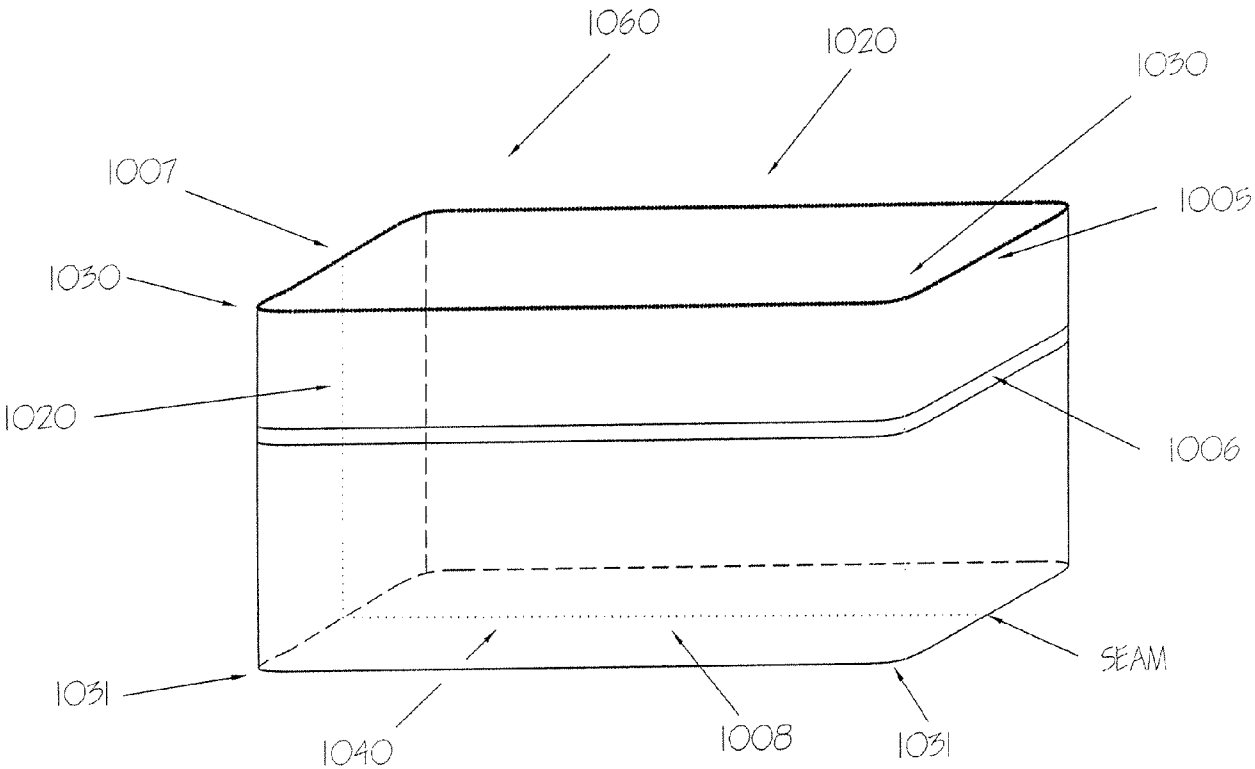
FIG. 3C is a perspective view of the bag of FIG. 3*a* with the triangular folds removed.
Figure 3D:
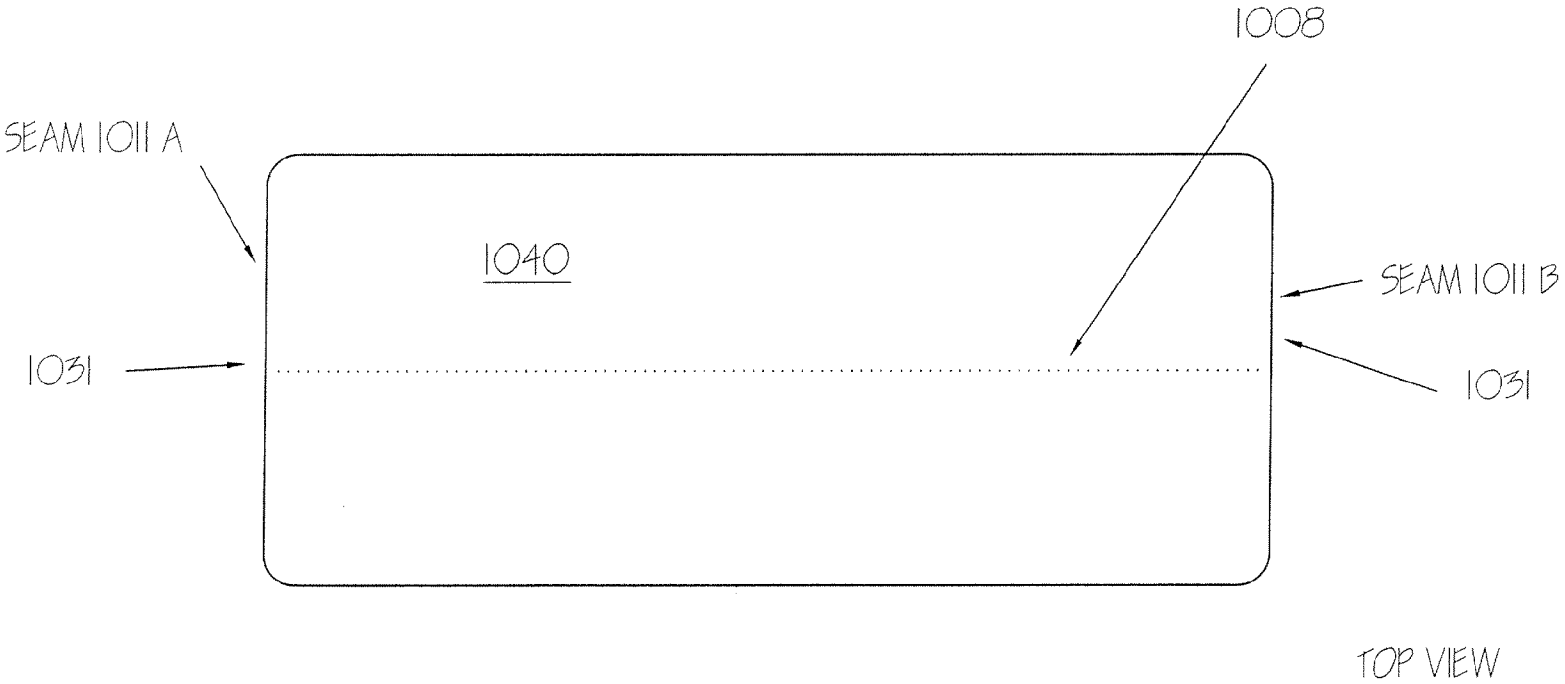
FIG. 3D is a top view of the bag in FIG. 3C.
Figure 4A:
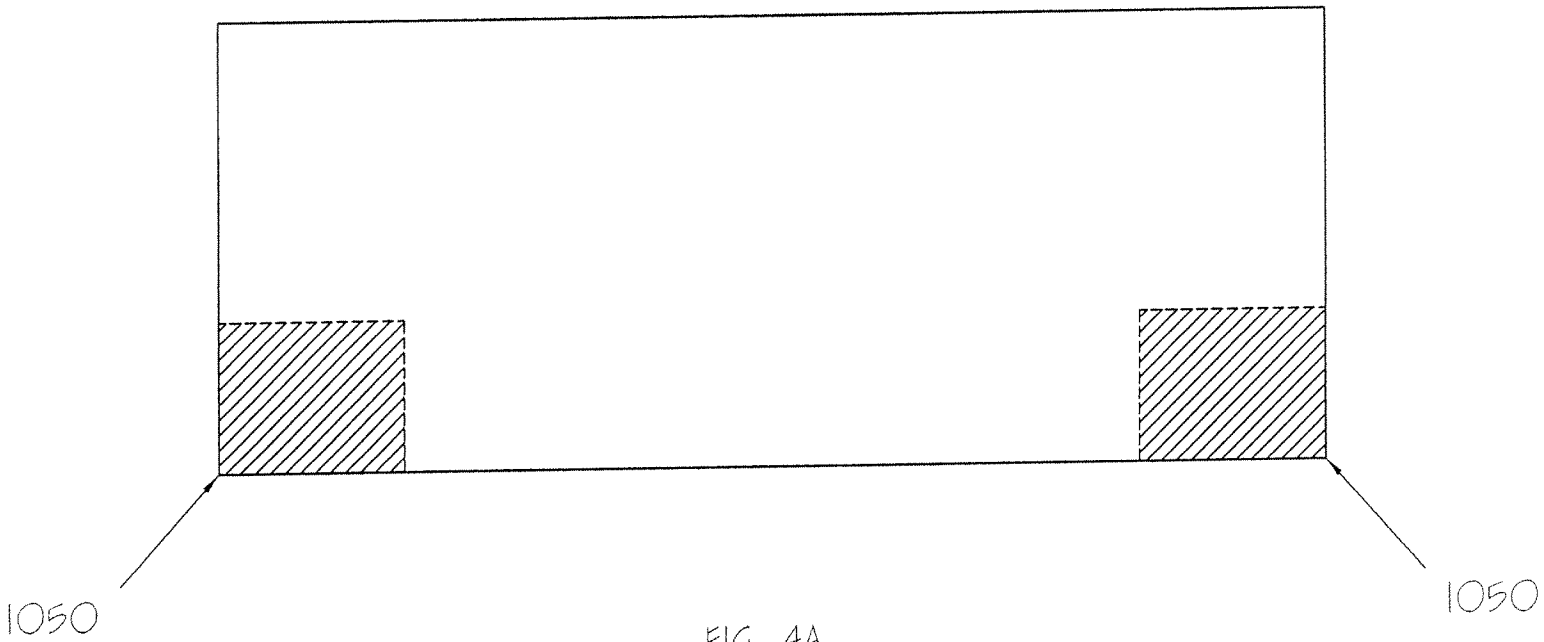
FIG. 4A is a plan view of the single piece construction removing fabric before assembly.

To create a rectangular shaped boxlike structure from this closed bottom cylinder the closed end of the tube structure is flattened inwardly, with excess bottom fabric forming two triangular shaped flaps 1010A and 1010B that extend outwardly from the tube bottom (see FIGS. 3A and 3B). It is preferred that the triangular folds 1010A and 1010B be formed so that the bottom seam or join 1008 forms the perpendicular bisector of the triangular flaps 1010A and B (see FIG. 3B). Each triangular flap 1010A and 1010 B is cut or sheared off and the cut edges joined (preferably by sewing) creating two bottom edge seams, 1011A and 1011B. The resulting structure now approximates a rectangular shaped open top box structure, having two long sidewalls 1020, two shorter end walls 1030 and a bottom 1040. See FIG. 3C. As seen in FIG. 3D, the bottom of the structure has a seam running down the center of the bottom 1008 and along the two edges of the bottom 1031 adjacent the end walls. In the preferred embodiment, one of the end walls 1030 has a seam 1007 running from the top to the bottom edge. See FIG. 3C. The fabric 1050 that will form these triangular folds can be removed or excised from the single fabric piece prior to assembly (such as shown in FIG. 4A), but this is not preferred, as it makes seam alignment during construction more critical for quality control. Alternatively, instead of removing these triangular folds, the triangular folds could be folded up and attached to the end walls or folded down and attached to the bottom of the bag. In this fashion, an open top boxlike structure is constructed from a single fabric piece.

Figure 4B:
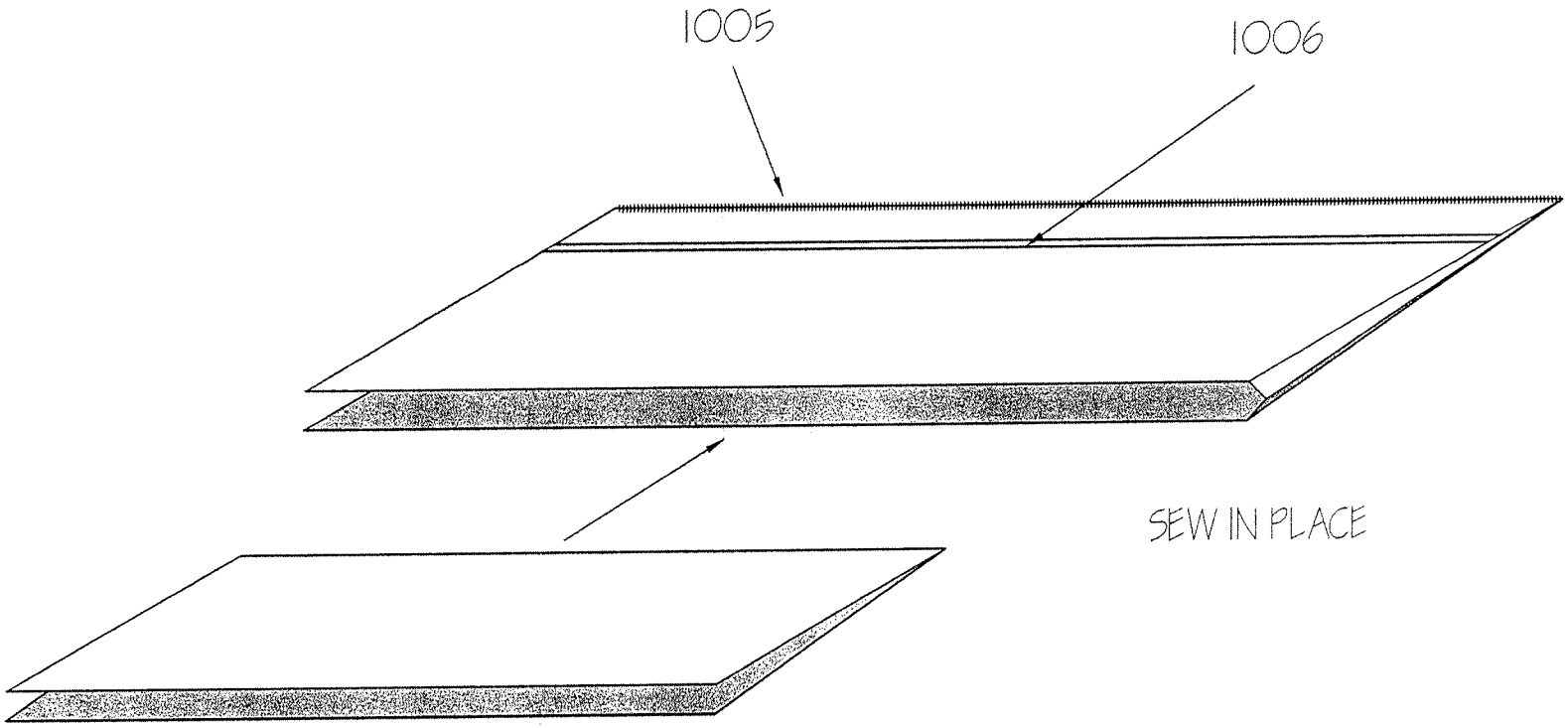
FIG. 4B is a plan view of a two piece construction embodiment having a separate bottom.

Alternatively, this same structure may be formed from two fabric pieced, the first fabric piece forming the sidewalls of the structure having the ½ zipper chain 1005 attached and edge strip 1006 attached. A separate bottom is then sewn in, such as shown in FIG. 4*b*. Alternatively, two intersecting pieces of fabric can be used having sections of edge strip 1006 and ½ zipper chain attached (FIG. 4B).

The next step is to form the top of the bag. Along the open top edge 1001D of the boxlike structure 1060 is the single side of a zipper chain 1005. The opposing sides of the open top are now operationally joined into a closable opening by attaching a zipper slide to the two half zipper chains, creating a functional zipper 1070. Two sipper slides may be added if desired. Zipper stops at added at the two opposing terminal ends of the zipper to maintain the zipper slide on the resulting zipper 1070. A zipper stop may simply be sewing the two ½ chains together, or otherwise fixing the two ½ chains together to keep the slide from sliding off the terminal ends, or can be a metal or plastic lug positioned at the end of each ½ chain to prevent the slide form exiting off the ½ chain. A #10 nylon coil zipper has been employed. The zippered top, when closed, again creates a toothpaste tube-like top end. The top end is pushed inwardly, again creating two triangular folds 1060A and 1060B on the top 1080 of the box shaped bag with the zipper bisecting the two triangular folds. See FIG. 5. As shown in FIG. 5, boxlike bag structure now has the edge strip 1006 positioned adjacent or near the top periphery of the edge forming the top portion 1080 of the bag.

These top triangular flaps 1060A and 1060B are designed to allow the top, when unzipped along the centerline, to be inverted "inside out" thereby allowing the top portion 1080 to be folded over the edges or upper terminating edge 11002 of the container or frame that the bag is placed in, thereby exposing the interior of the bag. The exposed opening is substantially aligned with the open top of the container or frame, allowing loading anywhere along the periphery of the container or frame. See FIGS. 6 A and B showing a container with bag placed inside. As described, the top opening of the bag has a zipper to closure device, but other closure means could be used, such as straps, ties, loops, Velcro, etc. As described, the bag is rectangular shaped, but the bag can be a square boxlike structure, or adapted to fix almost any container shape as the bag is manufactured from flexible fabric. For instance, for a cylindrical shaped container, the general design described above will work, but the bottom end may not be modified beyond creation of the toothpaste tube type bottom.

When used for construction debris, the bag may include an inner liner 30, lining all or part of the interior. One liner 30 is constructed from 6 to 12 oz non-woven polypropylene fabric (12 oz being most preferred with a 24,000 lb capacity bag). Alternatively, a liner can be constructed in multiple layers of differing fabrics or materials for strength, puncture resistance or other desired physical properties. It may be desired to reinforce the bag bottom against tearing, in which event a bottom panel can be glued or otherwise directly attached to the exterior bag bottom as a reinforcing patch, or an extra layer of fabric sized to accommodate the resulting bottom can be sewn on the one-piece sheet design in the appropriate location. Inner liner may have a separate zipper attached distinct from the topmost zipper.

Figure 12A:
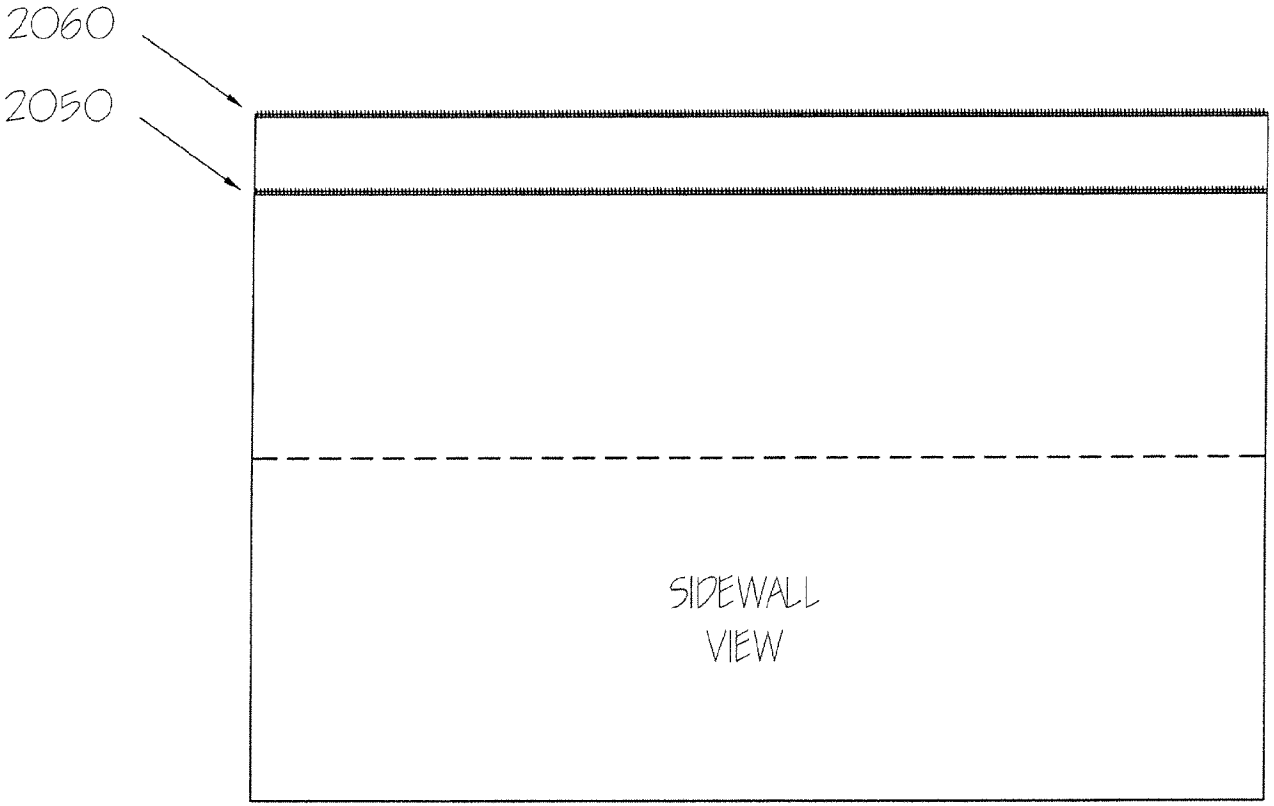
FIG. 12A is a plan view of the single piece double layered fabric composed showing an inner zipper and outer zipper. The view is an interior facing view.
Figure 12B:
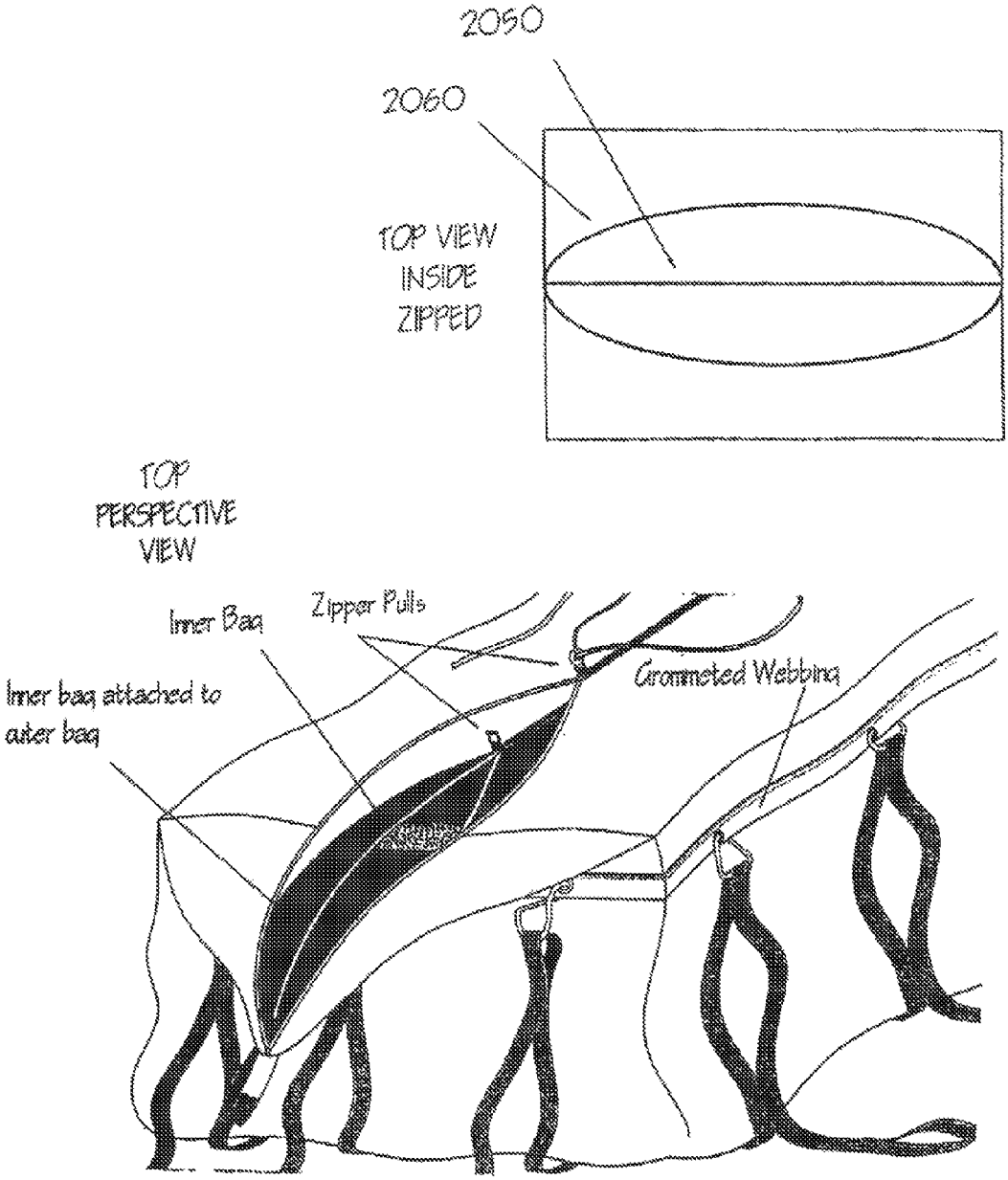
FIG. 12B is a top view showing of a double zippered bag showing the relationship of the zippers.

When two zippers are used, the liner and exterior fabric can be attached at the zippers, at the edge strip 1006, or between the edge strip and the zippers, or a combination. If only joined or attached at the edge strip, the liner and exterior fabric remain as separate flaps above the edge strip. Each can have a half zipper chain 1005A and 1005B attached, as shown in FIG. 7A. The liner may be cut slightly shorter (2-4 inches) then the topmost fabric (the "topmost" fabric is that fabric that will form the exterior facing fabric), making it easier for the liner and outer fabric to be zippered shut separately. If it is desired that the inner and outer fabric be joined along the top edge, the two can be seamed together above the edge strip. Alternatively, both inner and outer lining can be joined together when the ½ chain zipper is added if the inner liner is cut shorter (1-2 inches) or the inner zipper ½ chain 2050 is attached about 1-2 inches below the top edge (see FIGS. 12 A and B). The separation of the inner ½ chain zipper 2050 from the outer ½ chain zipper 2060 provides enough freedom between the two zippers on the assembled bag to allow closure of the inner then closure of the outer completed zipper.

This sheet constructed bag can be used with any lifting strap system know in the art, including a system of intersecting webbing straps are attached to the bag sidewalls, end walls or the bottom of the bag. For instance, the above describe one piece bag can be used with the lifting strap system described in the '727 patent. In this instance, the 5 strap 3 strap pattern intersect at right angles on the bag bottom and the straps are continuously attached on the bottom and walls of the bag, and extend above the bag for lifting. Alternatively, and more preferred, the lifting straps or webbing can be attached to the bag but left "detached" from the bag near the half portion of the bag, to prevent undue stress on the exterior surface of the bag during lifting operations. IAs described in the '662 application, retention loops can be used to position the lifting straps on the exterior surface of the bag, as shown in FIGS. 1-3 of the '662 application.

Additionally, the one piece bag can be used with a split lifting strap system having a side lifting portion and a bottom lifting portion as described in the '662 application, where the side or bottom portions can be attached either on the lower sidewalls or the bottom of the bag, or both. Again, it is preferred that the lifting strap system be detached from the exterior surface of the bag near the top portion of the bag. However, attaching the lifting strap system directly to the bag, such as by sewing (as described in the '727 patent) or attaching the lifting strap system straps indirectly through retention loops, requires extensive sewing to join the retention loops and the straps to the bag and is labor intensive.

A more preferred design is to use a lifting strap system that is everywhere detached from the bag or only indirectly attached to the bag (e.g. coupled to the bag) to support and lift the bag. As used herein, "directly" attached means a sewn or welded attachment (or another means of attachment) where the lifting strap, at the point of attachment, cannot move independently from the bag material. Indirect attachment, or coupling, is a means of positioning the lifting strap on the exterior of the bag but allows for movement of the strap with respect to the exterior bag material at the point of indirect attachment. For instance, using a retention loop to position the lifting strap on the bags, as shown in the '662 application, is indirect attachment or coupling of the lifting straps to the bag.

Figure 8:
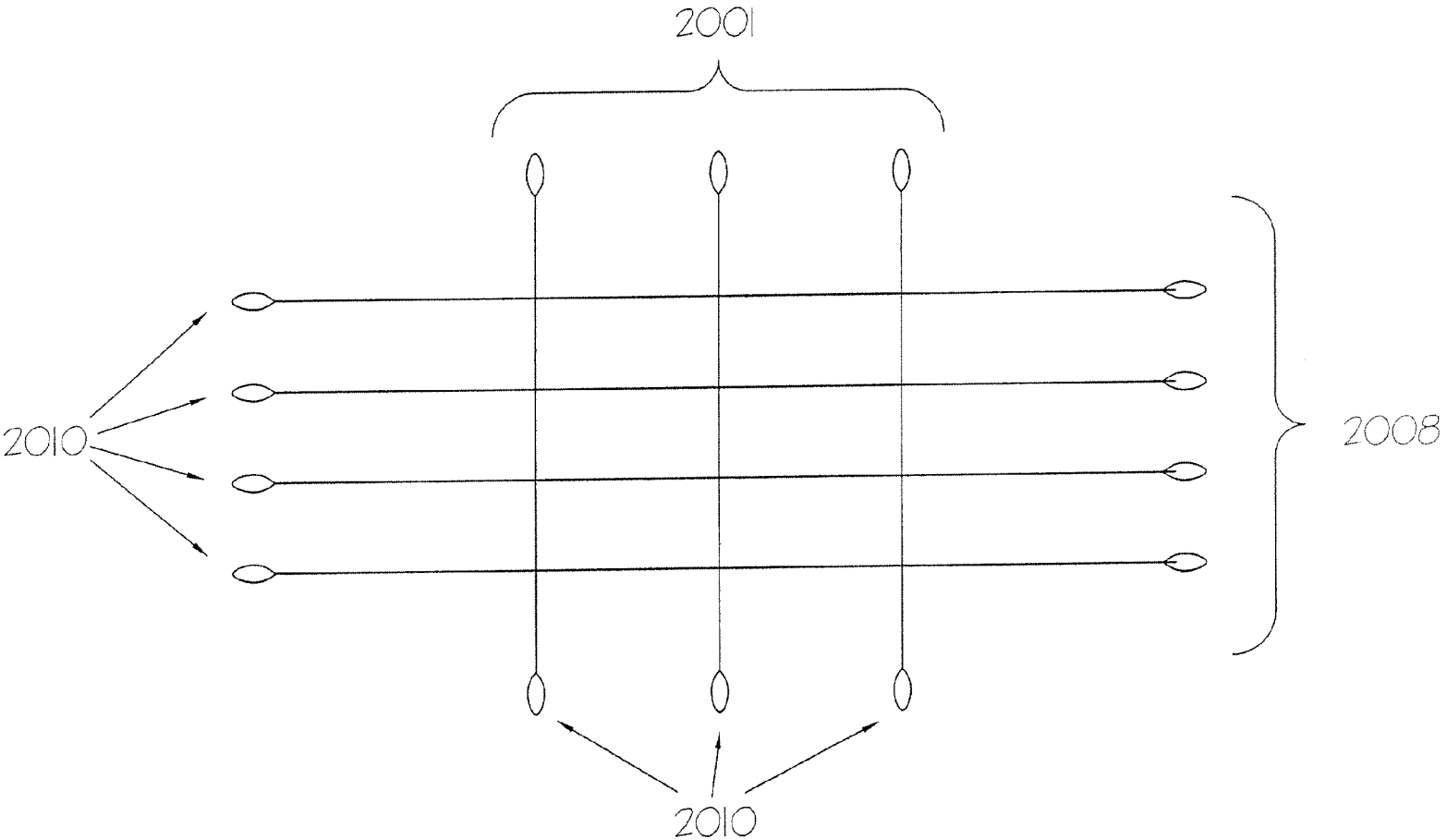
FIG. 8 is a perspective view of one embodiment of a lifting strap system.

A preferred lifting strap system is shown in FIG. 8. As shown, the system is a first series of parallel straps 2000, and a second series of parallel straps 2001, where the first and second series intersect at right angles creating a grid that will be located adjacent the bag bottom. Each strap has two distal ends that terminate in a connector 2010. As described, the straps are generally a fabric webbing, such as 2-3 inch polyester webbing, but other materials can be used. As generically described, the lifting strap system is composed of support straps, (continuous piece straps or multi piece straps). The connector can be a loop of fabric 2010 (shown in FIG. 8) or can be a connector such as a carbineer, snap hook, etc. or a partially or totally encircling perimeter support member (such as a rope). It is preferred that the first and second group of straps be directly joined at one or several point of intersection along the lifting system bottom portion to maintain a integrated structure, but it is not necessary that every intersection be a direct join. As shown in FIG. 8, the first groups of straps 2000 is a series of four straps, and the second group 2001 is a series of three straps. The actual number of straps in each group can vary with the application. The first group will extend between the long sidewalls and support the bag bottom, while the second group will extend between the shorter length end walls and support the bottom.

Figure 9:
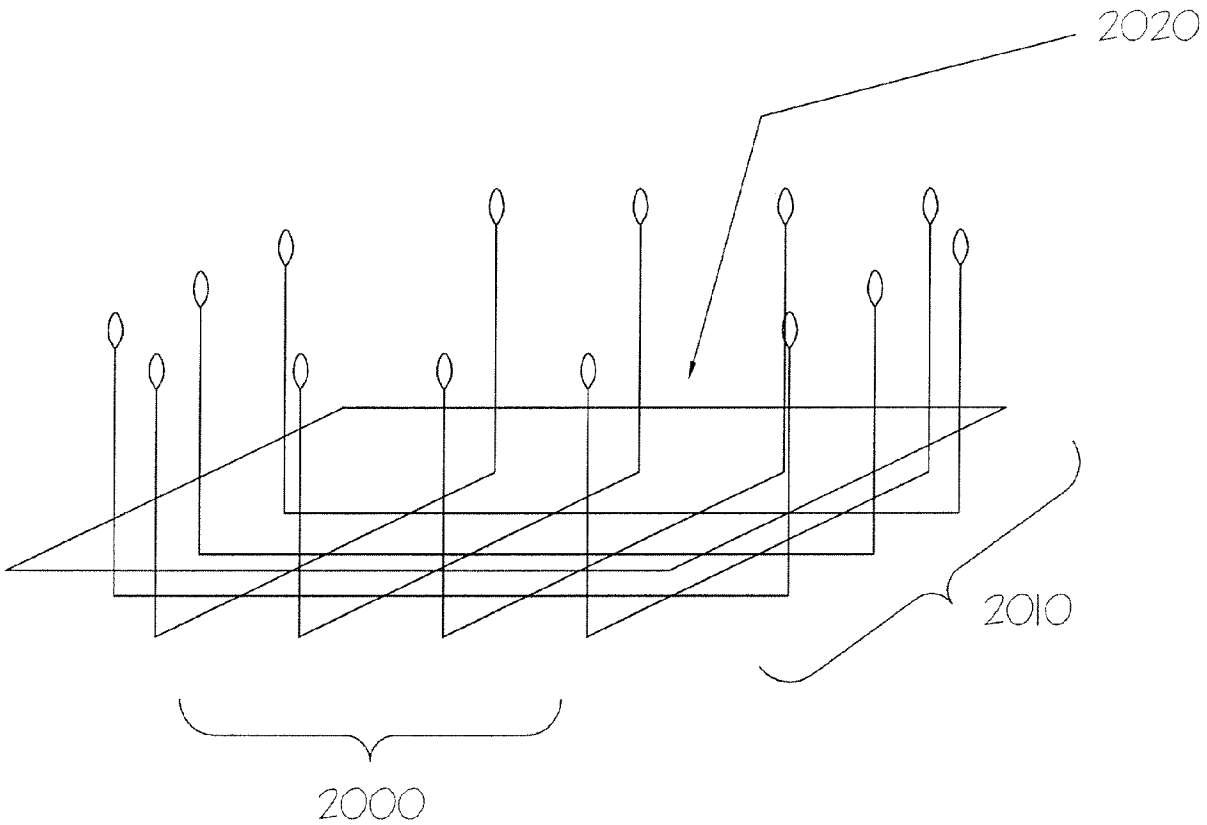
FIG. 9 is a perspective view of the lifting strap system of FIG. 8 with an encompassing belly strap.

Additional straps can be attached to the lifting strap system and placed at other locations on the lifting system, as desired. One such additional strap is positioned "horizontally" when the strap system is coupled to the bag, joining the first and second groups of straps. As shown in FIG. 9, this additional strap creates a perimeter encircling "belly strap" 2020 that is located at a height to provide support around the perimeter of the bag about ⅓-½ of the distance from the bag bottom. It has been found that a fully loaded bag naturally forms a teardrop like bulge near the bottom ½ of the bag. The belly strap 2020 provides additional sidewall and end wall support in this case. When using a belly strap 2020, it is not necessary that the first and second group of straps be directly joined at intersections along the bottom.

Other lifting strap system designs are possible. When torsional forces are a concern, the bottom portion of the lifting strap system can be constructed to accommodate side-to-side forces, such as the bottom design shown in FIG. 10 or 13 of the '662 application and included herein for reference. Preferred materials for the sling lifting straps are 1.5-3" wide polyethylene webbing, but other materials can be used where appropriate.

As described, the lifting strap system (henceforth considered as a number of straps) are joined together at some of all of the strap intersections, generally by sewing. The completed lifting strap system is a one piece unitary structure in the sense that there are enough direct joins of the crossing straps so that if the system is lifted at one strap, all straps will be lifted. The lifting strap system can be composed of two parts, a bottom weave and a side weave that can be joined together, as shown in FIGS. 1, 6 and 10 of the '662 application.

Figure 10A:
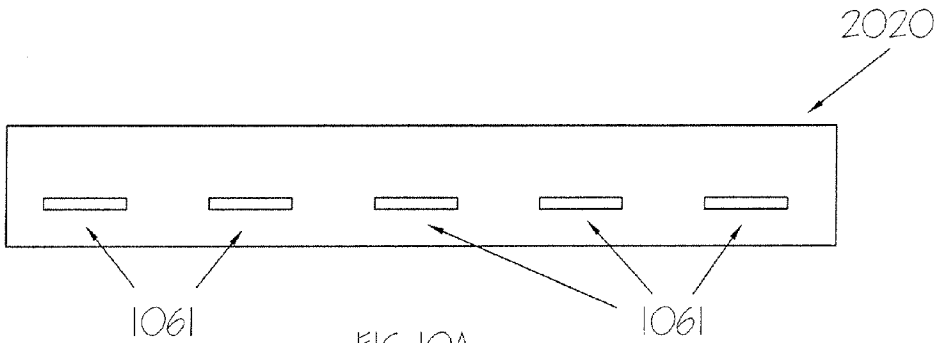
FIG. 10 A is a side view of one embodiment of an edge strip
FIG. 10C is a side view of another embodiment of an edge strip.
Figure 10B:
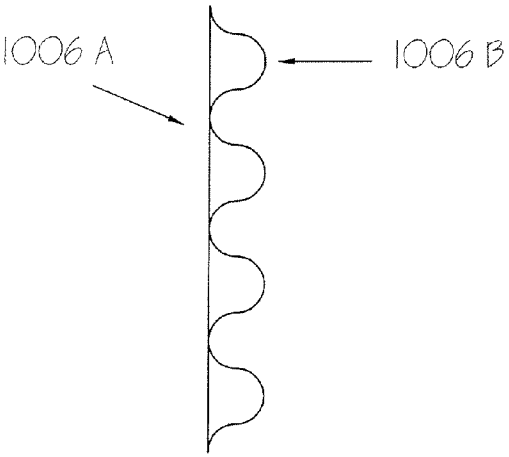
Figure 10C:
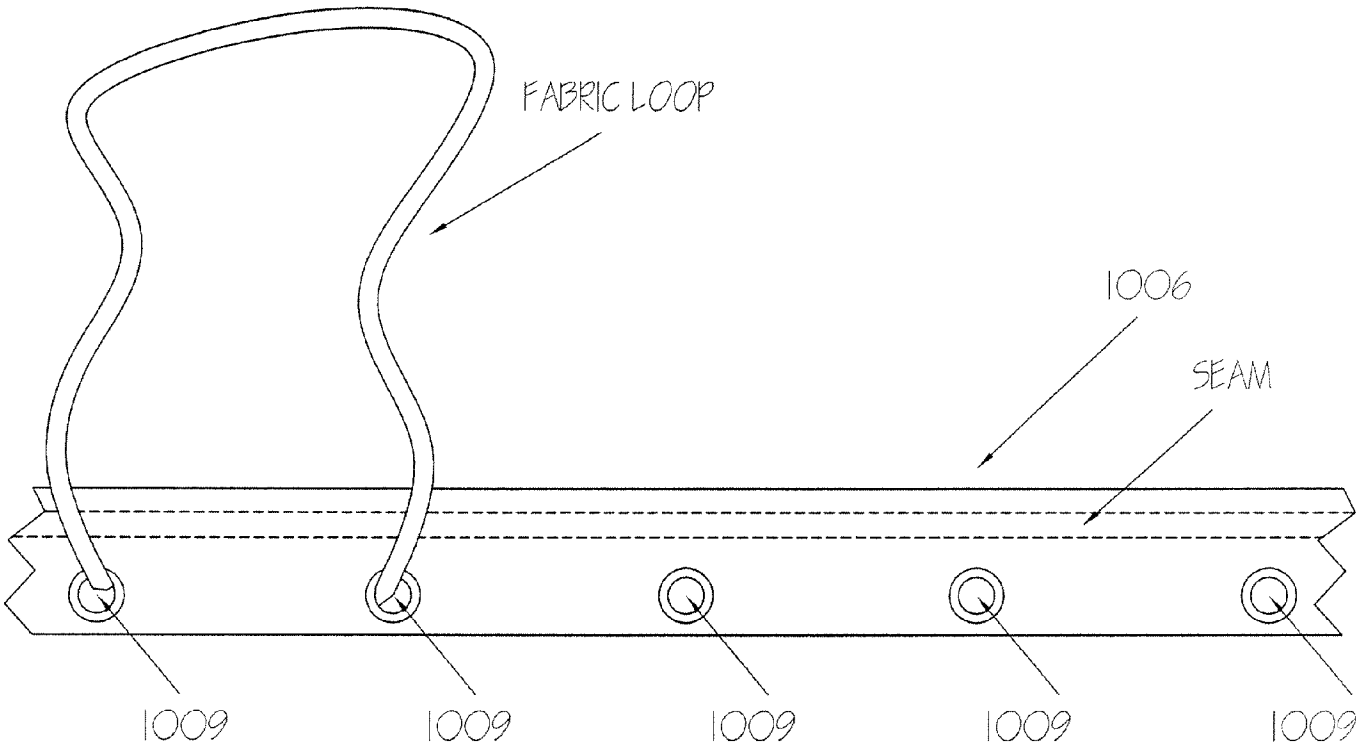

It is necessary to position the lifting strap system next to the lifting bag for lifting purposes. One means to position the lifting strap system is by using retention loops to couple or indirectly attach the straps to the bag, such as shown in FIG. 2 of the '662 application. These retention loops are short pieces of fabric, such as webbing, that are stitched to the bag at opposing ends of the fabric strip to create a loop much like a belt loop with a center opening through which a lifting strap can be threaded. Retention loops are positioned on the exterior surface of the bag as needed to support and properly position the lifting straps in the sling. However, it is simpler and more efficient to directly attach (sewn is the preferred method) to the bag exterior walls a single edge strip 1006, as described above. One version of the edge strip 1006 is shown in FIG. 10A. As shown, it is a single 2" wide webbing (such as polypropylene, polyester, polyethylene) strap with slits 1061 positioned along a line offset from the strap center line. The strap is attached (e.g. sewn) to the bag near the bag top edge, and the slits 1061 in the strap are aligned with the desired side lifting straps of the lifting strap system, allowing the side portions of the lifting strap system to be threaded through the slits 1061. Instead of a single strap, the edge strip 1006 can be constructed from two straps, one a straight strap 1006A that will be attached to the bag's side and end walls, and as second strap 1006B that is attached to the first strap 1006 leaving undulations in the second strap. A top view is of this two strap arrangement is shown in FIG. 10B. Alternatively, the edge strip 1006 may be a singled strap with grommets 1009 instead of slits positioned periodically therethrough (FIG. 10C). Individual fabric or webbing strips could be threaded through one or two grommets where needed to form a loop to accommodate one of the lifting straps, or a single fabric strip could be threaded though a series of grommets creating the undulations shown in FIG. 10C. It may be desired to also have another edge strip 1006 positioned around the bag's sidewall bottom perimeter or the edge of the bag adjacent to the bag bottom, to support the lifting straps near or on the bag bottom. Retention loops and the edge strip may be constructed from 1.5-2.5 inch polypropylene or polyester webbing, 1.5-2.5 inch elastic knitted latex webbing, ¾ inch rope, or any suitable material. Strap material can be constructed from 1.5-3 inch polypropylene, polyester or nylon webbing, ¾" rope (kermantal preferred) or other suitable materials.

In use, a lifting strap system is coupled to the bag by threading the individual straps (some or all) through the edge strip 1006, at suitable locations. By threading the lifting straps through the loops created by the edge strip, the lifting straps are positionally fixed horizontally (with some degree of movement) with respect to the bag, but still free to move vertically. It may be desired to removably fix the lifting straps vertically to the edge strip or retention loops. To accomplish this, a fastener is provided to removably bridge vertically around the edge strip. For instance, the area of the side straps near the loop on the edge strip are lined with one side of a hook and loop type fastener, such as Velcro. Attached to the lifting strap is a strip or flap of material (a closure flap) of the remaining side of the hook and loop type fastener. The closure strap is positioned to allow the closure strap to bridge across the edge strip material and connect to the lined area on the strap, thereby preventing the side strap from sliding through the retention loop.

Figure 4C:
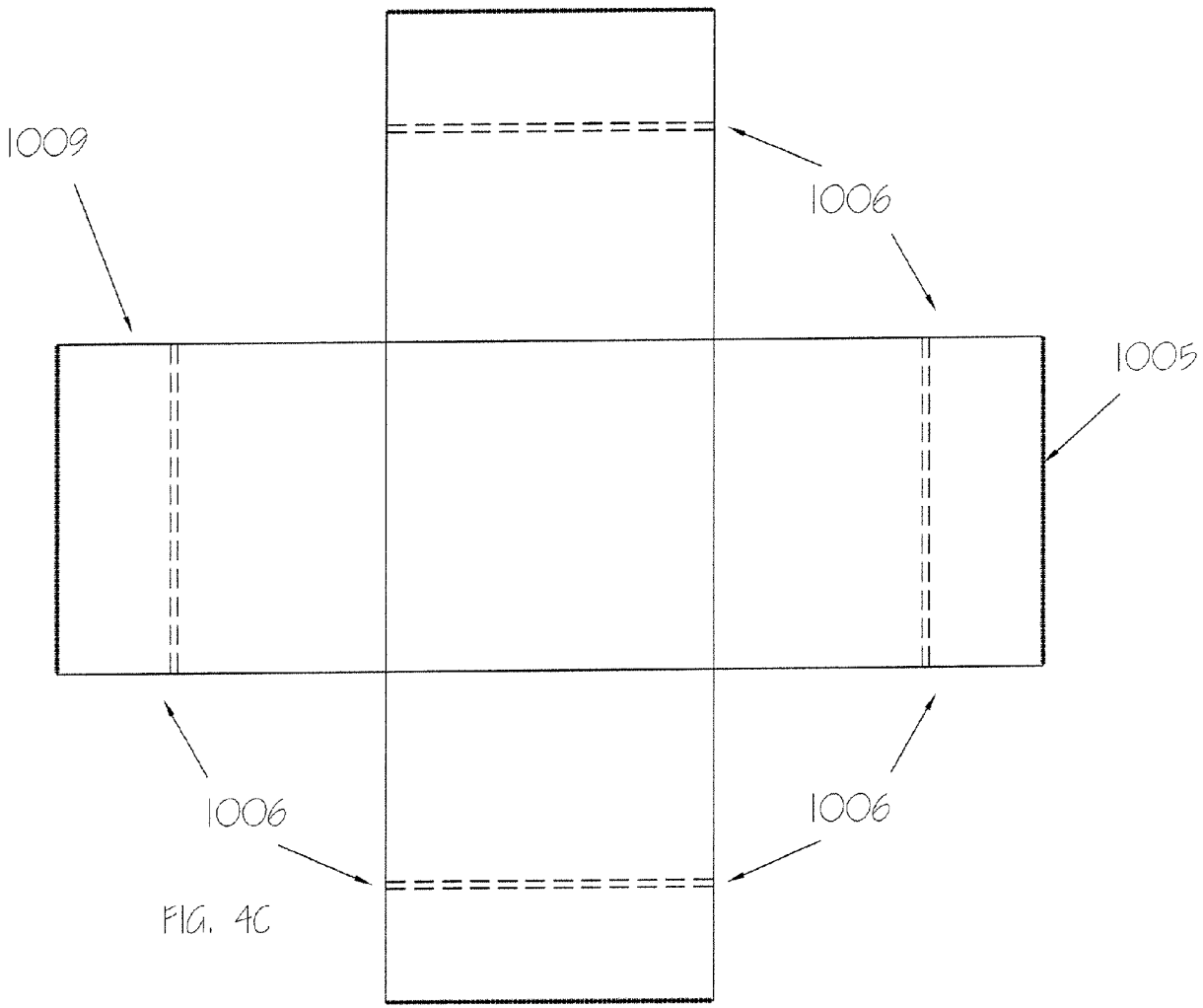
FIG. 4C is a plan view of a two piece construction using two overlapping panels.

For explanatory purposes, suppose the "loop" side of the fastener is positioned suitably on the lifting strap. Attached to the closure strap is the mating "hook" material. The closure strap bridges the opening in the edge strip (or retention loop) in a closed loop by the join of the hook and loop attachment member, capturing the edge strip material there between, thereby substantially fixing the vertical position of the strap with respect to the to the edge strip. This prevents the lifting strips from slipping through the edge strip and separating the sling from the lifting bag. The fastener should not be used during lifting of a loaded bag, as a lifting stress will be transmitted to the exterior walls of the bag by the fastener, potentially causing the exterior fabric to tear or rip, an undesired result. See FIG. 4 of the '662 application for details of this vertical attachment.

Though the use of retention loops, the side lifting straps can be decoupled from the bag exterior, allowing the bag to be lifted without using the bag fabric itself to supporting a lifting force (the bag vertically "floats" about the straps). This decoupling is important in preventing unnecessary stress on the bag and the bag seams. Because the bag is not a substantial lifting element, the bag, during lifting operations, will deform to some degree and is restrained from excessive deformation by the side lifting straps and retention loops. For instance, the top of the bag may "settle" to the load line since the lift straps are detached from the sides of the bag. By "detached" is meant that the lift straps are not directly attached (sewn, welded, adhered) to the bag fabric. The lift straps/bag fabric can move independently in the vertical direction due to the detachment of the lift straps from the bag. The straps simply slide through the retention loops. The side retention loops are present to retain the vertical geometry of the lifting straps during lifting. That is, the side retention loops allows the bag to move vertically with respect to the lifting straps, but substantially restrains the bag from moving sideways or horizontally with respect to the lifting straps (some horizontal movement will occur if the lift straps are much smaller that the opening created by the retention loops, say a ¾ wire rope in a retention strap having a 5-6 inch span or opening.

The bag is then placed in a frame or container, the top zipper 1070 is opened and the top inverted "inside out" over the sides of the frame or container. The bag is then loaded. Once the bag is filled to the desired height, the top of the bag is re-inverted into an outside "out" relationship, and the zipper 1070 closed. Once closed, the two end wall triangular pieces 1060 A and B are folded down onto the top, and can be joined together with a strap or wire or rope to keep these triangles from flapping during transportation. The lifting bag, once loaded or filled, can be lifted using a lifting frame, such as shown in FIG. 8 U.S. Pat. No. 6,142,727 and FIG. 14 herein, (suitably modified for the number of straps on the bag to be lifted) or any other type of lifting frame known in the art. For instance, a square frame lifting frame may be used instead of the parallel lifting bars attached with a center support such as shown in FIG. 14 of the '662 application. Generally each side support member is a lineal element with a top and bottom end: the top end attaches to the lifting frame and the bottom end attaches to or is attached to the bottom support. Alternatively, a rope or webbing may be threaded through the top loops of the lifting straps, and a crane used to lift the filled bag. Alternatively, the lifting straps or side support members can be made sufficiently long to allow the top loops to be gathered together, joined, and lifted by crane or other lifting device.

Figure 11:
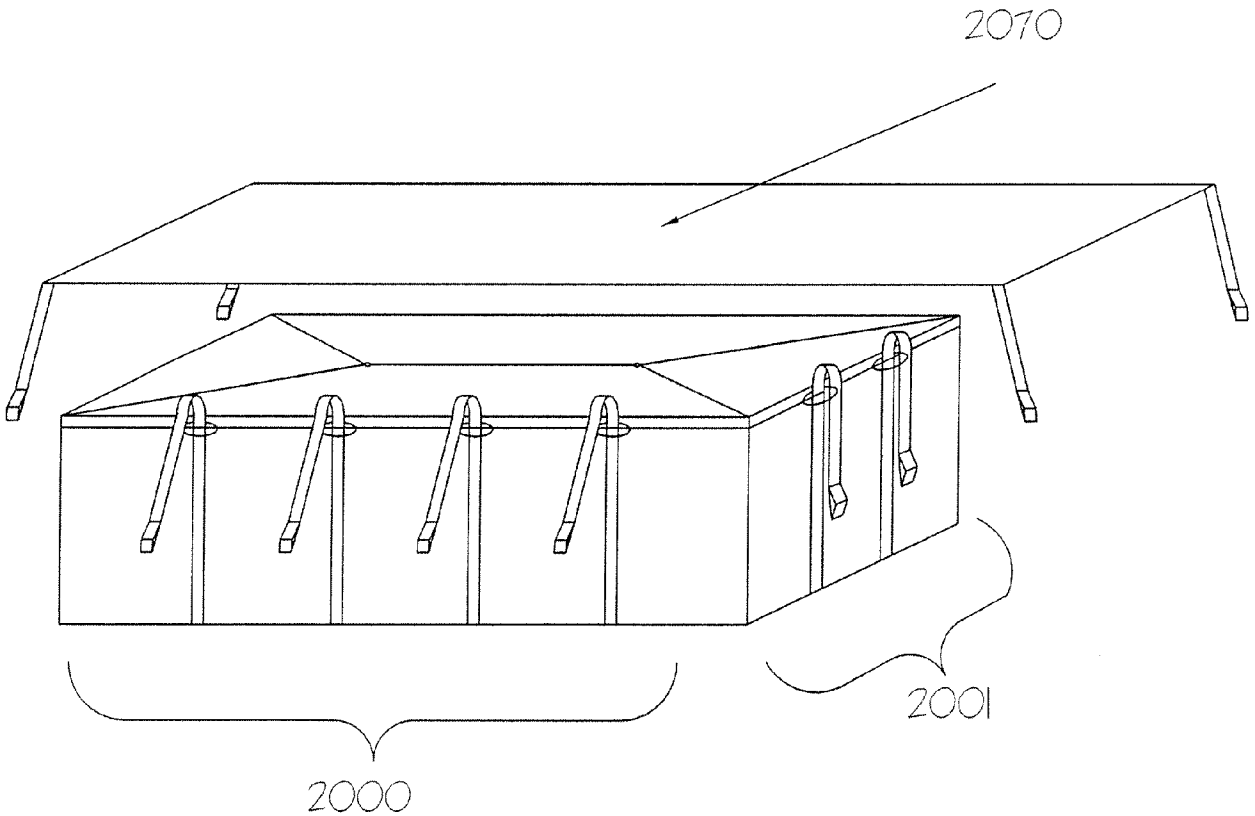
FIG. 11 is a perspective view of a completed lifting bag with lifting strap system and a raincap.

Finally, it may be desirable to include a rain cap for the bag. During storage of a loaded bag, the bag will settle, and a valley may form in the top of the bag, generally near the centerline. Because the zipper 1070 is in the center of the top, the zipper 1070 can be a source of water leakage into the bag interior. To prevent this, a rain cap 2070 can be provided to cover the top, such as shown in FIG. 11. One embodiment of such is a single piece of waterproof fabric that is draped over the bag's top and partially over the sides, and cinched down around the bag's top periphery using loops positioned along the bottom or sides of the bag, or off the belly strap or a similar location.

Finally, the bag can include a cinch straps positioned near the top four corners (preferably, two straps on each long side of the bag). The cinch straps can tie into the edge strip. For very large bags, additions cinch straps may be needed near the center of the bag. Cinch straps can be constructed from rope, polypropylene, polyester or other suitable material. The cinch straps runs vertically on the side of the bag and in use, allows the top of the bag to be drawn toward the bottom of the bag. A loop or connector can be attached to the bag as needed for coupling the cinch straps.

It is intended that the following claims be interpreted as covering all such alterations and modifications as fall within the true spirit and scope of the invention.

We claim:

1. A lifting bag comprising a) a fabric bag having a bottom, a sidewall, and a single, closeable opening, said single closable opening positioned adjacent to an upper end of the sidewall, said bottom being opposed to said single closable opening when opened, and said sidewall extending between said bottom and closable opening, b) a lifting strap system, said lifting strap system comprising a plurality of lifting straps forming a lifting sling positioned adjacent an exterior surface of said fabric bag, said lifting sling having a bottom extension of portions of said lifting straps, a sidewall extension of portions of said lifting straps and a top extension of portions of said lifting straps, said top extension of said portions of said lifting straps comprising a series of said lifting straps that terminate above said sidewall in a connector, each connector adapted to be attachable to a lifting device above said sidewall of said fabric bag, said lifting sling bottom extension further comprising an intersecting pattern of said plurality of lifting straps adjacent to said bottom of said fabric bag and adapted to support said bottom of said fabric bag; and c) a plurality of strap retention devices, a top subset of said strap retention devices coupled to said sidewall of said fabric bag, a first group of said lifting straps being coupled to said top subset of said strap retention devices, each said coupled lifting straps being free to move vertically between said bottom and said closable opening with respect to said exterior surface of said lifting bag.

2. The lifting bag according to claim 1 further having a bottom subset of said strap retention devices, said bottom subset positioned on or near said bottom of said fabric bag, said plurality of lifting straps being coupled to said bottom of said fabric bag by said bottom subset of said strap retention devices, each of said plurality of lifting straps being substantially fixed in position horizontally to said fabric bag by a corresponding bottom strap retention device, each of said lifting straps not directly attached to said fabric bag.

3. The lifting bag according to claim 1 wherein said strap retention devices comprise loops fixedly attached to said bag exterior.

4. The lifting bag according to claim 3, wherein said fabric bag is non-self supporting, and wherein said coupling of said fabric bag to said lifting straps via said plurality of strap retention devices allows said sidewall to be movable vertically relative to said coupled lifting straps.

5. The lifting bag according to claim 4, further comprising a plurality of fasteners, each fastener for removably fixing the position of one of said lifting straps to said fabric bag sidewall when said fastener is fastened.

6. The lifting bag of claim 5 wherein said fasteners further comprise a hook and loop type fastener, said hook and loop type fastener comprising a hook portion and a loop portion.

7. The lifting bag of claim 6 wherein each of said fasteners further comprises a closure strap, said hook portions of said hook and loop type fasteners are attached to one of said lifting straps and one of said closure straps, and wherein said loop portions of said hook and loop type fasteners are attached to the other of said lifting straps and said closure strap.

8. The lifting bag of claim 1 further having zipper, said zipper moving to close or open said single closable opening.

9. The lifting bag of claim 8 further having a bag top portion that has a length and a width, said bag top portion being adapted to form two opposing triangular shaped folds with said zipper extending between said two opposing triangular shaped folds, said triangular shaped folds adapted to fold over onto a partially covering relationship with said zipper when said zipper is closed.

10. The lifting bag of claim 8 wherein said zipper closes or opens a U shaped opening.

11. The lifting bag according to claim 1 wherein said intersecting pattern of said plurality of lifting straps adapted to support said bag on said closed bottom portion comprises a first series of lifting straps substantially parallel to one another on said bottom portion, and a second series of lifting straps substantially parallel on said bottom portion, said first series and said second series being substantially orthogonal to each other.

12. A lifting bag comprising a fabric non-self supporting bag having a closed bottom portion, a top portion, a closed sidewall extending between said bag top and bottom portion, and a closeable opening, said closable opening positioned only on said top portion, said bag bottom portion, said closed sidewall portion and said top portion defining a bag interior and a bag exterior; said bag configured to be positioned in a rigid loading frame for loading where the loading frame has a frame sidewall with a frame sidewall upper terminating edge and a frame sidewall lower terminating edge, and an open top extending between the frame sidewall upper terminating edge, and a frame bottom extending between the frame sidewall lower terminating edge, where the bag sidewall, when positioned in the loading frame, is adjacent to the frame sidewall and the bag bottom portion is adjacent the loading frame bottom and the single closable top, when opened, is substantially aligned with the upper terminating edge of the frame sidewall; and a lifting strap system, said lifting strap system comprising a series of lifting straps having a bottom extension of portions of said lifting straps, a sidewall extension of portions of said lifting straps and a top extension of portions of said lifting straps, said top extension of said portions of lifting straps further comprising a series of said lifting straps that terminate above said top portion of said bag and each terminating lifting strap terminates with a connector, each connector attachable to a lifting device above said bag top portion, said bottom extension of said lifting straps further comprising an intersecting pattern of said plurality of lifting straps adapted to support said bag on the exterior of said closed bottom portion when said lifting bag is supported and lifted by a lifting device by connecting said connectors to a lifting device; said bottom portion of said lifting bag being opposed to said bag top portion and further defined as that portion of said lifting bag that materials first rest against when loaded into an empty lifting bag, said lifting strap system being coupled to said bag exterior but not directly attached to said bag bag exterior but moveable with respect to said bag sidewall and said bag bottom portion.

13. The lifting bag according to claim 12 wherein said lifting strap system is further coupled to said bag near said bottom portion of said bag.

14. The lifting bag according to claim 12 further having a series of fasteners, each of said fasteners adapted to removably couple one of said lifting straps to said lifting bag to substantially fix the vertical position of said lifting straps near said bag top portion when so coupled.

15. The lifting bag of claim 14 wherein said fasteners further comprise a hook and loop type fastener.

16. The lifting bag of claim 12 wherein said bag top portion further has a zipper, said zipper moving to close or open said closable opening.

17. The lifting bag of claim 16 where said bag top portion has a length and a width, said bag top portion being adapted to form two opposing triangular shaped folds with said zipper extending between said two opposing triangular shaped folds, said triangular shaped folds adapted to fold over onto a partially covering relationship with said zipper when said zipper is closed.

18. A lifting bag comprising:

a) a fabric bag defining an interior volume for containing a load, said fabric bag having a rectangular shaped closed bottom with a terminating bottom perimeter, one or more walls extending upwardly from said bottom perimeter, and a single, closeable opening, said single closable opening positioned adjacent to an upper end of the one or more walls;

b) a plurality of upper strap retention devices attached to the fabric bag's one or more walls; and c) a lifting sling comprising a plurality of lifting straps positioned adjacent an exterior surface of the fabric bag for supporting the load, the lifting straps comprising: i) lower portions positioned adjacent to the fabric bag's bottom, ii) middle portions positioned adjacent to the fabric bag's walls, and iii) upper portions extending above the fabric bag, wherein the middle portions of the lifting straps engage the upper strap retention devices to couple the lifting straps to the fabric bag yet allowing the lifting straps to be movable vertically relative to the upper strap retention devices, and wherein the bottom portions of the lifting straps form an intersecting pattern adjacent to the fabric bag's bottom to support the bottom.

19. The lifting bag of claim 18, further comprising a lifting device positioned above the fabric bag, and a plurality of connectors releasably connecting the lifting straps' upper portions to the lifting device.

20. The lifting bag of claim 19, wherein the fabric bag and the load define a weight, with the weight being supported entirely by the lifting sling positioned around the exterior periphery of the fabric bag when the lifting bag is raised by the lifting device.

* * * * *